US011658380B2

(12) United States Patent
Massa et al.

(10) Patent No.: US 11,658,380 B2
(45) Date of Patent: May 23, 2023

(54) TUNING ELEMENTS WITH REDUCED METAL DEBRIS FORMATION FOR RESONANT CAVITY FILTERS

(71) Applicant: CommScope Italy S.R.L., Agrate Brianza (IT)

(72) Inventors: Riccardo Massa, Treviglio (IT); Gabriele Riva, Milan (IT); Antonio Sala, Agrate Brianza (IT)

(73) Assignee: CommScope Italy S.R.L.

( * ) Notice: Subject to any disclaimer, the term of this patent is extended or adjusted under 35 U.S.C. 154(b) by 204 days.

(21) Appl. No.: 17/255,586

(22) PCT Filed: Jul. 11, 2019

(86) PCT No.: PCT/EP2019/068679
§ 371 (c)(1),
(2) Date: Dec. 23, 2020

(87) PCT Pub. No.: WO2020/011920
PCT Pub. Date: Jan. 16, 2020

(65) Prior Publication Data

US 2021/0159581 A1 May 27, 2021

Related U.S. Application Data

(60) Provisional application No. 62/696,959, filed on Jul. 12, 2018.

(51) Int. Cl.

| | |
|---|---|
| ***H01P 7/06*** | (2006.01) |
| ***H01P 1/208*** | (2006.01) |
| ***H01P 1/213*** | (2006.01) |

(52) U.S. Cl.
CPC ..... *H01P 7/06* (2013.01); *H01P 1/208* (2013.01); *H01P 1/2138* (2013.01)

(58) Field of Classification Search
CPC ..... H01P 1/2138; H01P 1/208; H01P 7/06
USPC ..... 333/206, 207
See application file for complete search history.

(56) References Cited

U.S. PATENT DOCUMENTS

| | | | | |
|---|---|---|---|---|
| 4,001,737 | A | 1/1977 | Scott | |
| 2011/0241801 | A1* | 10/2011 | Subedi | H01P 1/2053 333/203 |
| 2015/0116058 | A1 | 4/2015 | Lee et al. | |

FOREIGN PATENT DOCUMENTS

| | | | |
|---|---|---|---|
| GB | 842131 | A | 7/1960 |

OTHER PUBLICATIONS

International Search Report and Written Opinion of the International Searching Authority in corresponding PCT Application No. PCT/EP2019/068679 (dated Oct. 18, 2019).

* cited by examiner

*Primary Examiner* — Rakesh B Patel
(74) *Attorney, Agent, or Firm* — Myers Bigel, P.A.

(57) ABSTRACT

A resonant cavity filter includes a housing having a resonator therein, and a tuning element including an elongated pin member having a conductive outer surface. The tuning element is mounted for insertion of the elongated pin member into an interior of the resonator. The conductive outer surface includes a contact portion by which the elongated pin member is secured in a desired position to adjust a frequency response of the resonant cavity filter, where the contact portion is free of threading.

25 Claims, 28 Drawing Sheets

TUNING ELEMENTS WITH REDUCED METAL DEBRIS FORMATION FOR RESONANT CAVITY FILTERS

CLAIM OF PRIORITY

The present application is a 35 U.S.C. 371 national stage application of PCT International Application No. PCT/EP2019/068679, filed on Jul. 11, 2019, which claims the benefit of and priority from U.S. Provisional Patent Application No. 62/696,959 entitled "*Tuning Elements With Reduced Metal Debris Formation For Resonant Cavity Filters*" filed on Jul. 12, 2018, the disclosures of which are incorporated by reference herein in their entireties.

FIELD

The present invention relates generally to communications systems and, more particularly, to filters that are suitable for use in cellular communications systems.

BACKGROUND

Cellular base stations are known in the art and typically include, among other things, baseband equipment, radios and antennas. FIG. 1 is a simplified, schematic diagram that illustrates a conventional cellular base station 10. As shown in FIG. 1, the cellular base station 10 includes an antenna tower 30 and an equipment enclosure 20 that is located at the base of the antenna tower 30. A plurality of baseband units 22 and radios 24 are located within the equipment enclosure 20. Each baseband unit 22 is connected to a respective one of the radios 24 and is also in communication with a backhaul communications system 44. Three sectorized antennas 32 (labelled antennas 32-1, 32-2, 32-3) are located at the top of the antenna tower 30. Three coaxial cables 34 (which are bundled together in FIG. 1 to appear as a single cable) connect the radios 24 to the respective antennas 32. In many cases, the radios 24 are located at the top of the tower 30 instead of in the equipment enclosure 20 in order to reduce signal transmission losses.

Cellular base stations can use phased array antennas 32 that include a linear array of radiating elements. Typically, each radiating element is used to (1) transmit radio frequency ("RF") signals that are received from a transmit port of an associated radio 24 and (2) receive RF signals from mobile users and pass these received signals to the receive port of the associated radio 24. Duplexers are typically used to connect the radio 24 to each respective radiating element of the antenna 32. A "duplexer" refers to a known type of three-port filter assembly that is used to connect both the transmit and receive ports of a radio 24 to an antenna 32 or to one or more radiating elements of multi-element antenna 32. Duplexers are used to isolate the RF transmission paths to the transmit and receive ports of the radio 24 from each other while allowing both RF transmission paths access to the radiating element(s) of the antenna 32.

FIG. 2 is a perspective view of a conventional duplexer 50. FIG. 3 is a perspective view of the conventional duplexer 50 of FIG. 2 with the cover plate 78 removed therefrom. FIG. 4 is a perspective view of the duplexer 50 of FIGS. 2-3 with the top cover and resonators removed to more clearly show the cavities within the filter housing.

Referring to FIGS. 2-4, the conventional duplexer 50 includes a housing 60 that has a floor 62 and a plurality of sidewalls 64. An interior ledge 66 is formed around the periphery of the housing 60. Internal walls 68 extend upwardly from the floor 62 to divide the interior of the housing 60 into a plurality of cavities 70. Coupling windows 72 are formed within the walls 68, and these windows 72 as well as openings between the walls 68 allow communication between the cavities 70. Internally-threaded columns 74 and resonating elements 76 are provided within the housing 60. The resonating elements 76 may include, for example, dielectric resonators or coaxial metal resonators, and may be mounted onto selected ones of the internally threaded cavities 74. A cover plate 78 acts as a top cover for the duplexer 50. Screws 80 are used to tightly hold the cover plate 78 into place so that the cover plate 78 continuously contacts the interior ledge 66 and the top surfaces of the walls 68.

The duplexer 50 further includes an input port 82, an output port 84 and a common port 86. The input port 82 may be attached to an output port of a transmit path phase shifter (not shown) via a first cabling connection 83. The output port 84 may be attached to an input port of a receive path phase shifter via a second cabling connection 85. The common port 86 may connect the duplexer 50 to one or more radiating elements of the antenna (not shown) via a third cabling connection (not shown). A plurality of tuning screws 90 are also provided. The tuning screws 90 may be adjusted to tune aspects of the frequency response of the duplexer 50 such as, for example, the center frequency of the notch in the filter response. It should be noted that the device of FIGS. 2-4 illustrates two duplexers that share a common housing, which is why the device includes more than three ports (the device includes a total of six ports, although all of the ports are not visible in the views of FIGS. 2-4).

FIGS. 5A and 5B are perspective views of some conventional tuning screws shown mounted in top covers of respective filters. Referring to FIG. 5A, a tuning screw 100 is shown mounted in a top cover 120 of a filter housing. The top cover 120 has a plurality of apertures 130 extending therethrough, which may be threaded (two apertures 130 are depicted in FIG. 5A, one of which has the tuning screw 100 inserted therein). A threaded nut 140 may be provided above each aperture 130. Tuning screws 100 can be threaded through the respective apertures 130 (only one tuning screw 100 is shown). The tuning screws 100 can readily be threaded further into or further out of the threaded apertures 130, and hence into or out of the cavity of the filter, and the nuts 140 may be used to fix the screws 100 in a desired position, which may facilitate very precise tuning of the filter. In other embodiments a thicker top cover 120 may be used that has threaded apertures formed therein, which may eliminate the need for separate threaded nuts 140.

Referring to FIG. 5B, a cover 170 of a filter housing is depicted that includes a self-locking tuning screw 150 mounted therein. The self-locking tuning screw 150 is mounted in a threaded aperture 180 in the cover 170 (a second threaded aperture 180 is illustrated in FIG. 5B that does not have a tuning screw 150 therein). The self-locking tuning screw 150 may operate in the same fashion as the tuning screw 100 discussed above.

SUMMARY

According to some embodiments of the present disclosure, a resonant cavity filter includes a housing having a resonator therein, and a tuning element including an elongated pin member having a conductive outer surface. The tuning element is mounted for insertion of the elongated pin member into an interior of the resonator. The conductive outer surface includes a contact portion by which the elongated pin member is secured in a desired position to adjust a frequency response of the resonant cavity filter, where the contact portion is free of threading.

In some embodiments, the tuning element further includes a turret member having an opening therein that is aligned with the interior of the resonator. The elongated pin member extends through the opening in the turret member for the insertion into the interior of the resonator and is secured by an interference fit between the contact portion and the turret member.

In some embodiments, the turret member includes a plurality of fingers respectively positioned around a perimeter of the opening therein. The fingers are flexible and/or elastic to grip the contact portion of the elongated pin member therebetween to secure the elongated pin member in the desired position.

In some embodiments, the tuning element further includes a ring-shaped member having an inner surface that is shaped to mate with outer surfaces of the fingers such that acceptance of the fingers into the ring-shaped member causes the fingers to grip the contact portion of the elongated pin member therebetween.

In some embodiments, the outer surfaces of the fingers define a tapered shape, and the inner surface of the ring-shaped member is tapered to mate with the tapered shape of the fingers.

In some embodiments, the outer surfaces of the fingers include an external thread pattern, and the ring-shaped member is a nut having an internal thread pattern on the inner surface thereof that is configured to mate with the external thread pattern.

In some embodiments, first portions of the outer surfaces of the fingers include the external thread pattern, and second portions of the outer surfaces of the fingers are tapered relative to the first portions.

In some embodiments, the second portions of the outer surfaces of the fingers are tapered from a dimension corresponding to a diameter defined by the inner surface of the ring-shaped member to a dimension greater than the diameter.

In some embodiments, the ring-shaped member has an elasticity sufficient to cause the fingers to grip the contact portion of the elongated pin member therebetween responsive to acceptance of the fingers into the ring-shaped member.

In some embodiments, the turret member has a threaded hole in a sidewall thereof that is configured to accept a screw-shaped member, and the screw-shaped member is configured to be laterally threaded into the threaded hole to contact the contact portion to secure the elongated pin member in the desired position.

In some embodiments, the housing further includes a top cover with an aperture therein that is aligned with the interior of the resonator, and the turret member is mounted on the cover with the opening therein coaxially aligned with the aperture.

In some embodiments, the turret member includes an extended base portion that extends through and beyond the aperture in the top cover and into the interior of the resonator.

In some embodiments, the aperture in the top cover is tapered in a direction away from the interior of the resonator. The turret member includes an external thread pattern protruding outside of the aperture opposite the resonator, which is configured to mate with an internal thread pattern of a nut. Outer surfaces of the fingers are tapered to mate with the aperture such that acceptance of the fingers into the aperture responsive to tightening of the nut around the external thread pattern of the turret causes the fingers to grip the contact portion of the elongated pin member therebetween.

In some embodiments, the opening in the turret member includes an internal thread pattern and is tapered toward the interior of the resonator, and the tuning element further includes an elastic ring and a nut that are sized to fit within the opening in the turret member, with the nut having an external thread pattern that is configured to mate with the internal thread pattern. The elongated pin member extends through the elastic ring and the nut for the insertion into the interior of the resonator, and tightening the nut advances the elastic ring into the opening and toward the interior of the resonator causing compression of the elastic ring against the contact portion to secure the elongated pin member in the desired position.

In some embodiments, the housing further includes a top cover with an aperture therein that is aligned with the interior of the resonator, and the conductive outer surface of the elongated pin member is expandable to contact a sidewall of the aperture to secure the elongated pin member in the desired position by an interference fit with the contact portion.

In some embodiments, the elongated pin member includes a hollow opening extending along a major axis thereof within the conductive outer surface thereof.

In some embodiments, the tuning element further includes a screw-shaped member, and the hollow opening in the elongated pin member is tapered and is configured to accept the screw-shaped member. Insertion of the screw-shaped member into the hollow opening causes expansion of the contact portion of the conductive outer surface to contact the sidewall of the aperture to secure the elongated pin member in the desired position.

In some embodiments, the hollow opening includes an internal thread pattern that is configured to mate with a thread pattern of the screw-shaped member, and an end of the elongated pin member opposite the hollow opening is closed.

In some embodiments, the elongated pin member further includes an elastic inner portion defining the hollow opening and including the conductive outer surface thereon. The elastic inner portion is configured for compression during insertion of the elongated pin member into the aperture, and for expansion responsive to release of the compression to secure the elongated pin member in the desired position by the interference fit with the contact portion.

In some embodiments, the elongated pin member includes an elongated bar member extending within a hollow opening in the conductive outer surface. The hollow opening has a varying width and the elongated bar member has a wider portion at an end thereof proximate the interior of the resonator, and retraction of the elongated bar member into the hollow opening causes expansion of the contact portion to contact a sidewall of the turret member to secure the elongated pin member in the desired position.

In some embodiments, the turret member includes an external thread pattern protruding outside of the aperture opposite the resonator, and the tuning element is a nut having an internal thread pattern on the inner surface thereof that is configured to mate with the external thread pattern.

According to some embodiments of the present disclosure, a resonant cavity filter includes a housing having a resonator therein and a top cover with an aperture therein that is aligned (e.g., coaxially) with an interior of the resonator, and a tuning element. The tuning element includes an elongated pin member that is mounted for insertion through the aperture in the top cover and into the interior of the resonator. The tuning element is fixed in a desired position by an interference fit with a contact portion on a conductive outer surface of the elongated pin member, without rotational friction.

In some embodiments, the contact portion is free of a thread pattern.

In some embodiments, the tuning element further includes a turret member mounted on the top cover and having an opening therein that is coaxially aligned with the aperture. The elongated pin member extends through the opening in the turret member for the insertion through the aperture and into the interior of the resonator.

In some embodiments, the turret member includes a plurality of fingers respectively positioned around a perimeter of the opening therein. The fingers are flexible to clamp the contact portion of the elongated pin member therebetween to fix the elongated pin member in the desired position.

In some embodiments, first portions of outer surfaces of the fingers include an external thread pattern, and second portions of the outer surfaces of the fingers are tapered from a dimension corresponding to a diameter defined by the first portions to a dimension greater than the diameter.

In some embodiments, the turret member includes a threaded hole in a sidewall thereof that is configured to accept a screw-shaped member. The screw-shaped member is configured to be laterally threaded into the threaded hole to pin the contact portion between the screw-shaped member and a sidewall of the opening in the turret member to fix the elongated pin member in the desired position.

In some embodiments, the conductive outer surface of the elongated pin member is expandable to contact a sidewall of the aperture or a sidewall of the turret to secure the elongated pin member in the desired position.

In any of the above embodiments, the resonant cavity filter may be a duplexer or a diplexer.

Further features, advantages and details of the present disclosure, including any and all combinations of the above embodiments, will be appreciated by those of ordinary skill in the art from a reading of the figures and the detailed description of the embodiments that follow, such description being merely illustrative of the present disclosure.

DETAILED DESCRIPTION

Figure 1:
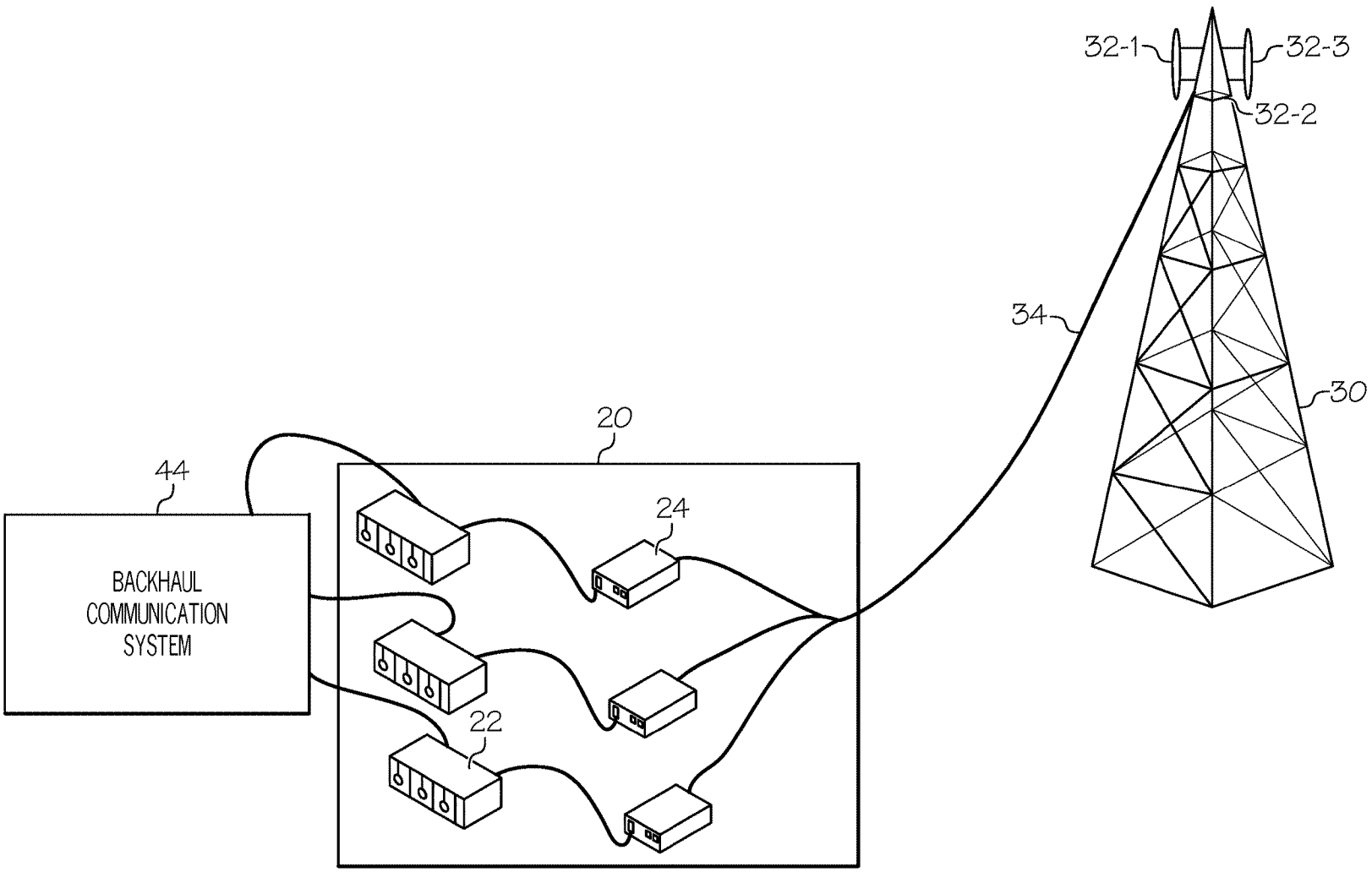
FIG. 1 (PRIOR ART)
FIG. 1 is a simplified, schematic diagram of a conventional cellular base station.
Figure 2:
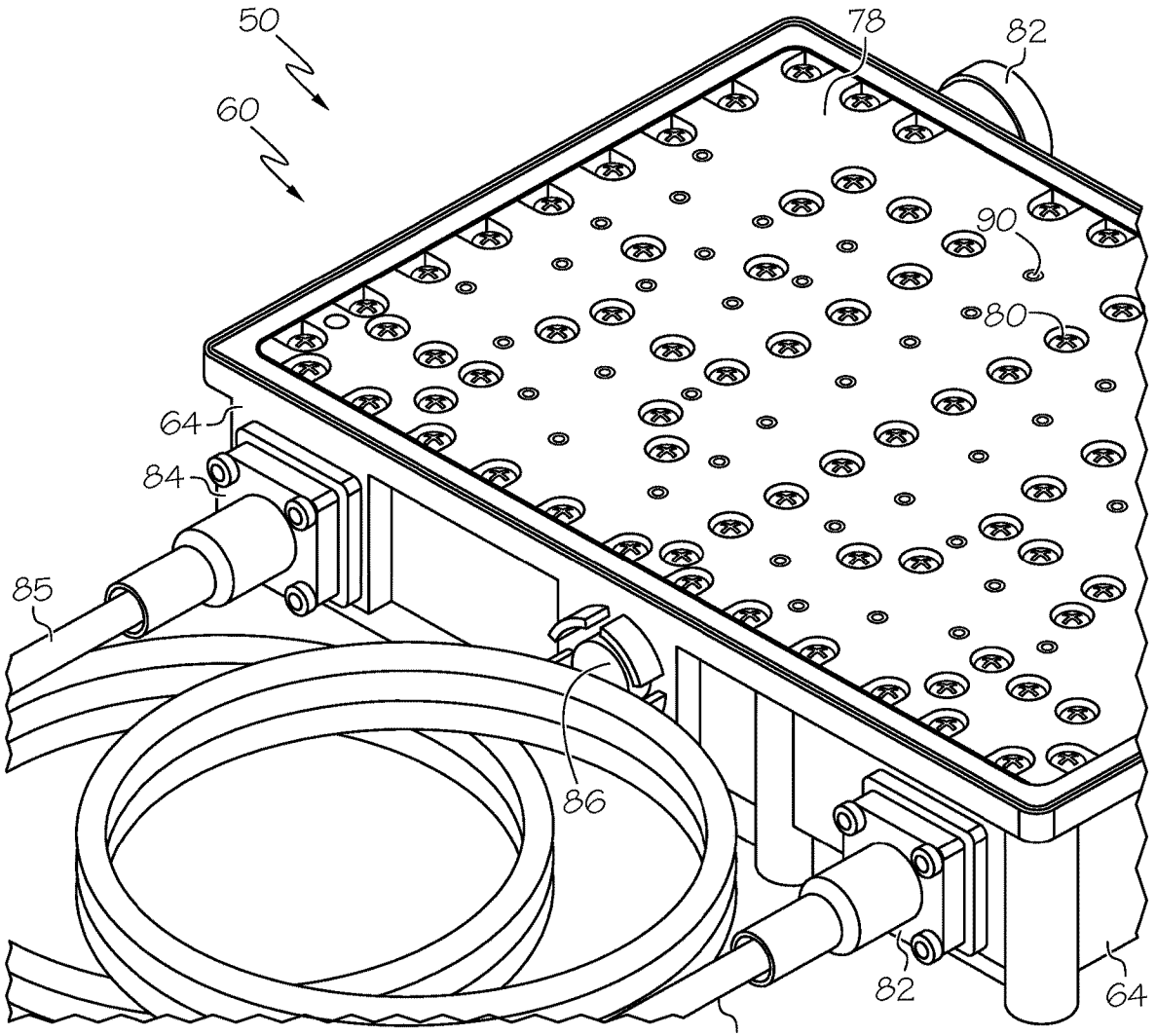
FIG. 2 (PRIOR ART)
FIG. 2 is a perspective view of a conventional duplexer.
Figure 3:
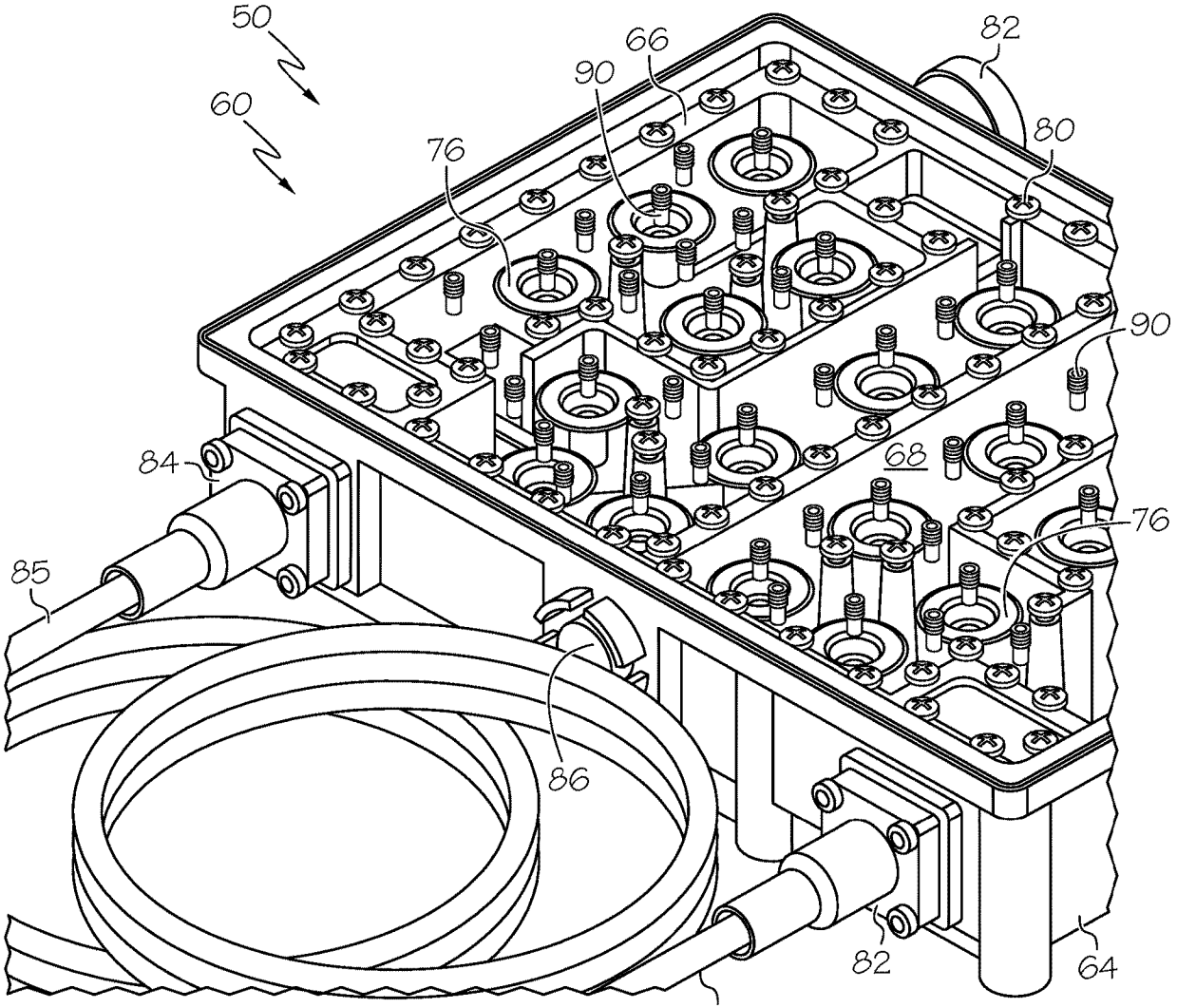
FIG. 3 (PRIOR ART)
FIG. 3 is a perspective view of the conventional duplexer of FIG. 2 with the cover plate removed therefrom.
Figure 4:
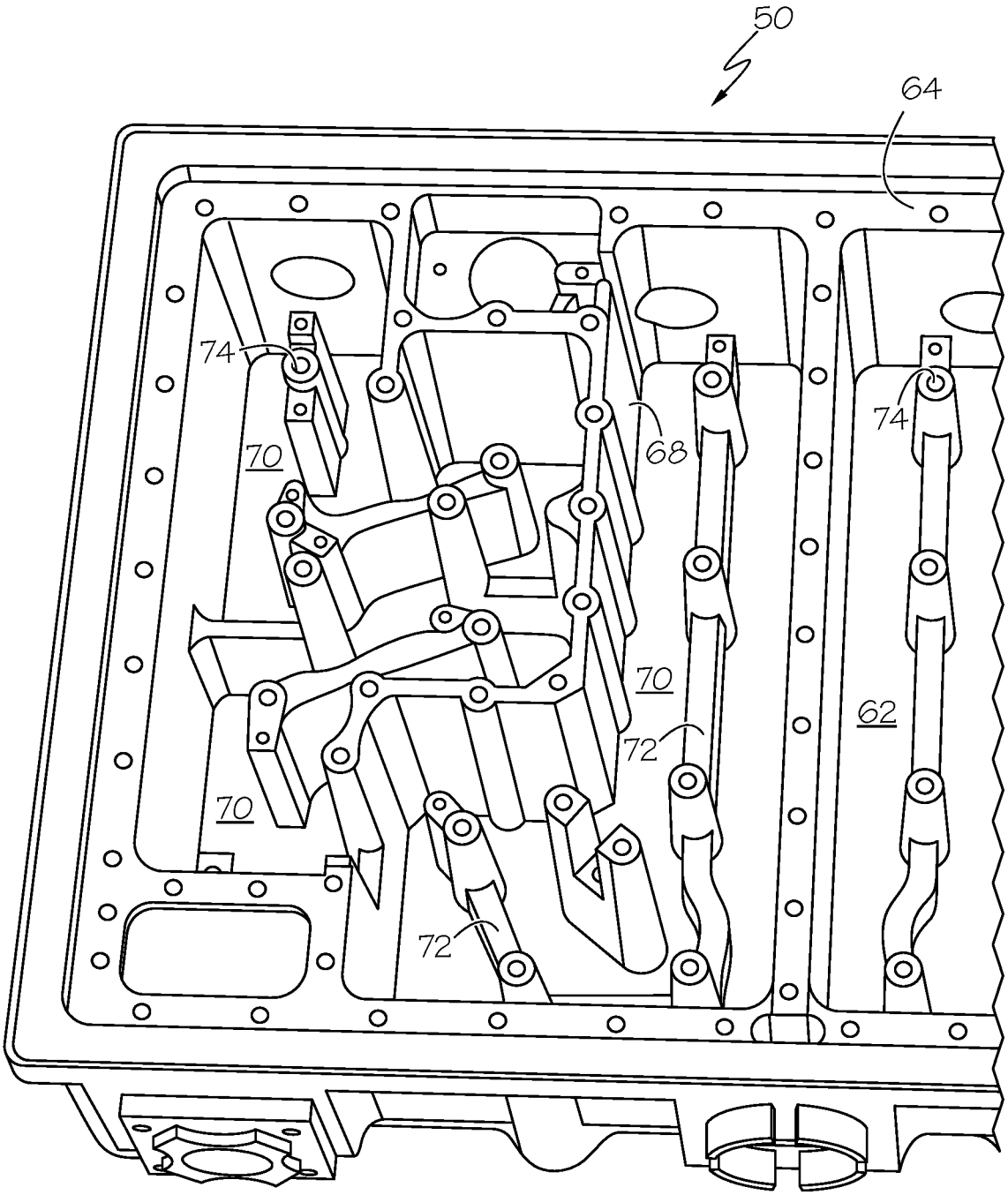
FIG. 4 (PRIOR ART)
FIG. 4 is a perspective view of the duplexer of FIGS. 2-3 with the top cover and resonators removed.
Figure 5A:
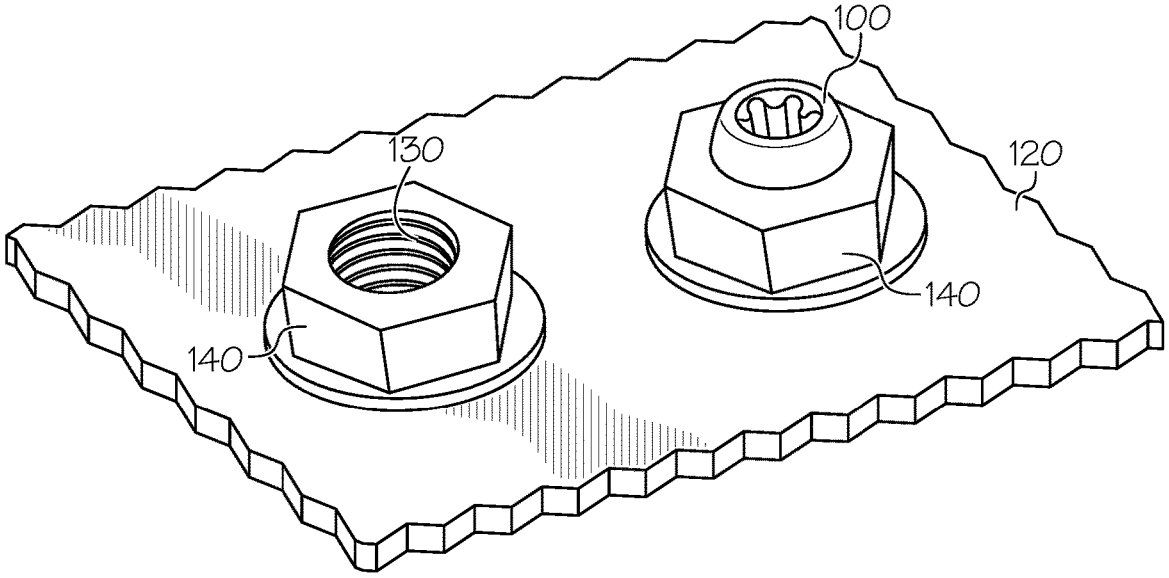
FIG. 5A (PRIOR ART)
FIGS. 5A-5B are perspective views of a conventional tuning screw and a conventional self-locking tuning screw, respectively.
Figure 5B:
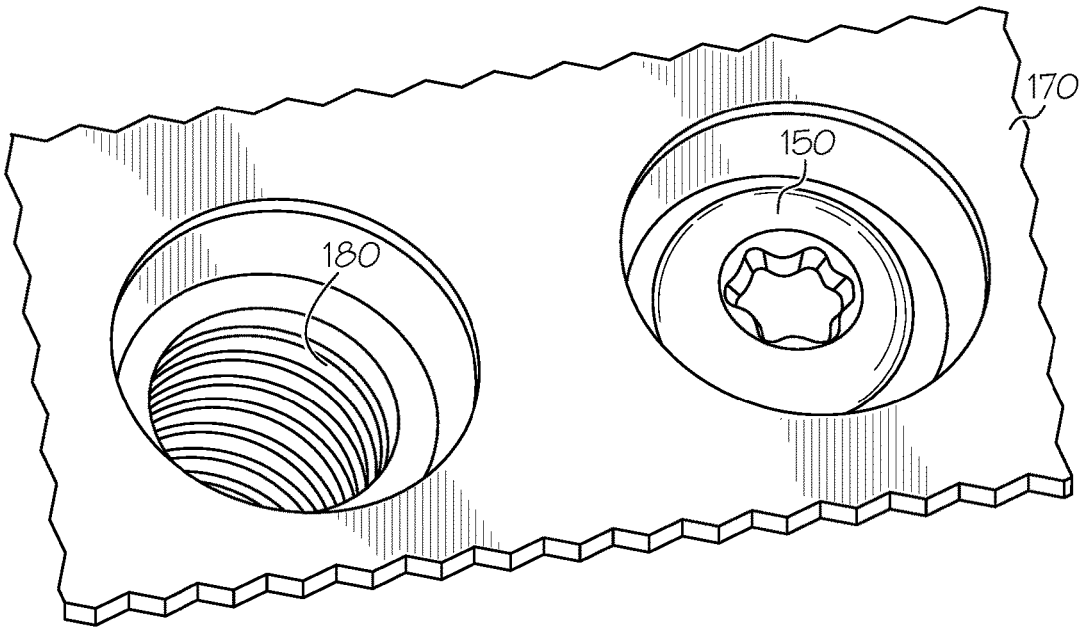
FIG. 5B (PRIOR ART)

Passive Intermodulation ("PIM") distortion is a known effect that may occur when multiple RF signals are transmitted through a communications system. PIM distortion may occur when two or more RF signals encounter non-linear electrical junctions or materials along an RF transmission path. Such non-linearities may act like a mixer, causing new RF signals to be generated at mathematical combinations of the original RF signals. If the newly generated RF signals fall within the bandwidth of existing RF signals, the noise level experienced by those existing RF signals may be effectively increased. When the noise level is increased, it may be necessary reduce the data rate and/or the quality of service.

PIM distortion can be a significant interconnection quality characteristic for an RF communications system, as PIM distortion generated by a single low quality interconnection may degrade the electrical performance of the entire RF communications system. Thus, ensuring that components used in RF communications systems generate acceptably low levels of PIM distortion may be desirable. In particular, minimizing and controlling the effects of PIM distortion may be used to achieve high end performance. PIM performance may also be a recognized market differentiator and provides competitive advantage, enabling increased data transfer efficiency.

PIM can be generated by many factors. One possible source of PIM distortion may be due to inconsistent metal-to-metal contact along an RF transmission path. For example, conventional tuning screws for a resonant cavity RF filter form metal-to-metal contacts where the metal screws are threaded into a mating metallic nut of the filter housing. It is standard practice to tune the RF filter to a desired frequency response through the careful placement of apposite tuning screws in a position that provides the desired tuning effect. This process slowly brings the filter from detuned to tuned condition by continuous re-touching of screws position. Given the strong RF interactions within each screw and other screws, the tuner may continuously move one screw, then move another screw, and subsequently move the same screw or screws multiple times.

However, microscopic loose metal particles may be created by adjustment of the tuning screws in the resonating cavities of the filter. The creation of such metal particles typically occurs during the tuning phase of the filter, as a purpose of tuning screws is to provide a method of adjusting the frequency response of the filter in a desired fashion based on the depth to which the screw is inserted within the filter cavity. These repeated rotations of the screws can create the metal particles that fall into filters cavities and generate PIM. In particular, the plating on the screws or related threaded holes (silver, copper or other well conductive metals) may be scraped on the surface and small flakes and debris may be generated.

Pursuant to embodiments of the present invention, resonant cavity filters are provided that have improved tuning elements. The resonant cavity filters may be duplexers, diplexers, combiners, or the like, which are suitable for use in cellular communications systems and other applications. The filters and tuning elements may be designed so that the metal-to-metal contacts resulting from threading between the components or members of the tuning elements are effectively outside of the adjacent filter cavity, so that metal shavings and/or metal debris that may be formed due to contact and/or adjustment of the components are less likely to fall within the housing of the filter, where such metal shavings/debris may give rise to PIM distortion.

More generally, the metal-to-metal contact at the threading between components of the tuning element may be eliminated and/or otherwise provided non-adjacent to openings in the cover for the filter housing, such that the creation of such small metal particles from the metal-to-metal contact is reduced and/or is prevented from falling into the corresponding resonating cavity of the filter. In some embodiments, tuning elements may include a conductive pin member (rather than a conventional screw) with a non-threaded contact portion on its outer surface. As used herein, non-threaded refers to the absence of a thread pattern (or "threading") on the described surface. The pin member can be moved up and down (i.e., into and out of the filter cavity) and secured by the contact portion or otherwise fixed in a desired position in a stable manner, while at the same time providing a good electrical contact. For example, in some embodiments the tuning element may include an intervening turret member that is configured to accept the pin member within an opening or aperture above the filter cavity, and to guide the pin member into or out of the interior of the resonator. In some embodiments, the pin member itself may be configured to expand its outer diameter to be secured by the contact portion directly in the aperture above the filter cavity. Thus, by removing the interface between threading patterns from a space that is gravitationally adjacent the filter cavity, resonant cavity filters and tuning elements according to embodiments of the present invention may provide improved PIM distortion performance as compared to conventional resonant cavity filters.

Figure 6:
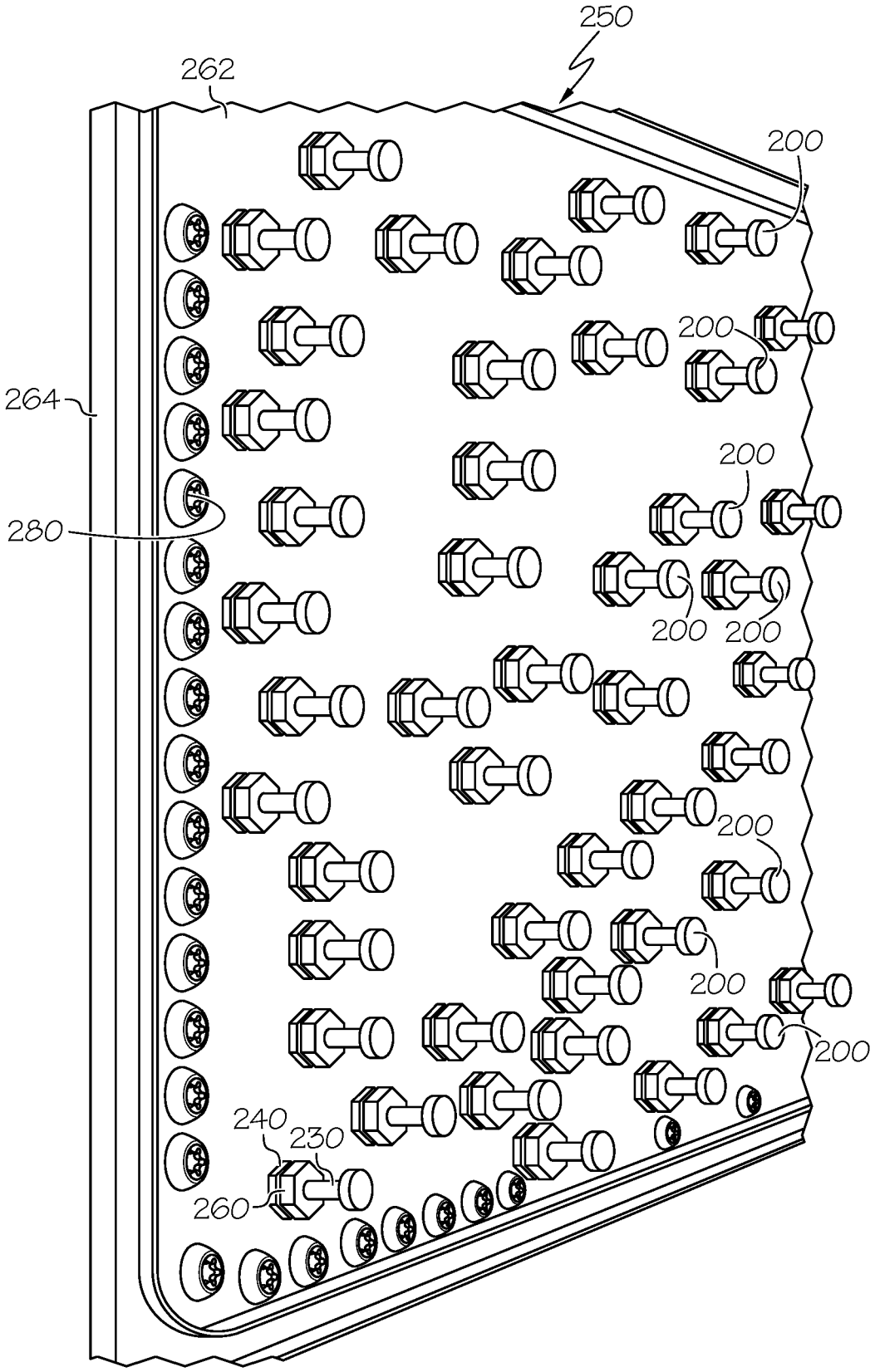
FIG. 6 is a perspective view of a resonant cavity filter including tuning elements according to embodiments of the present invention.
Figure 7A:
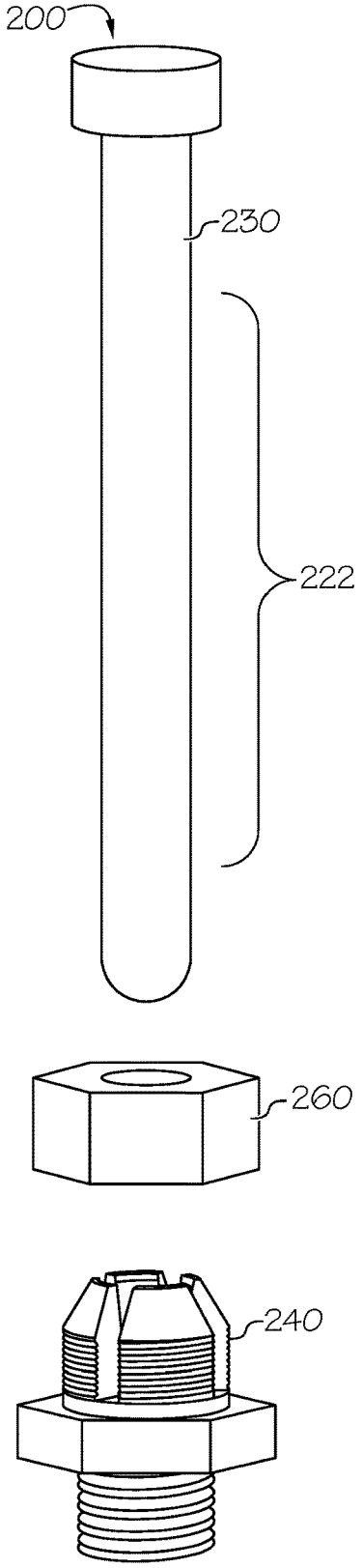
FIG. 7A is a perspective view of a tuning element according to embodiments of the present invention.
Figure 7B:
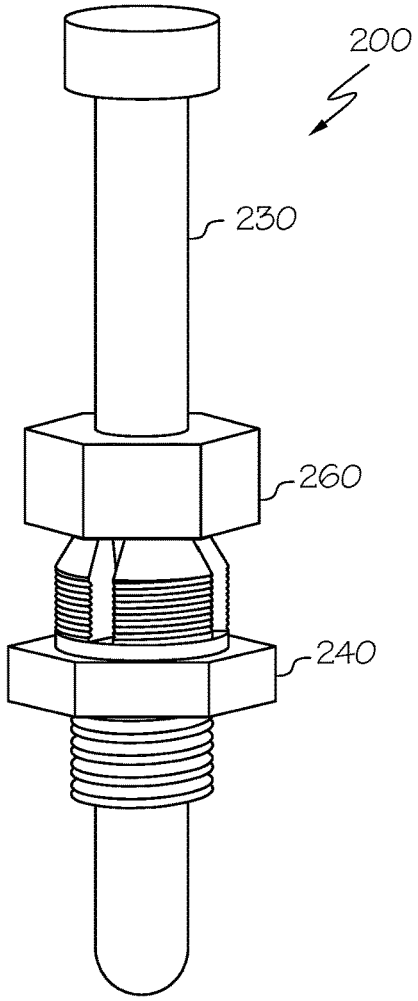
FIG. 7B is an exploded perspective view of the tuning element of FIG. 7A.
Figure 7C:
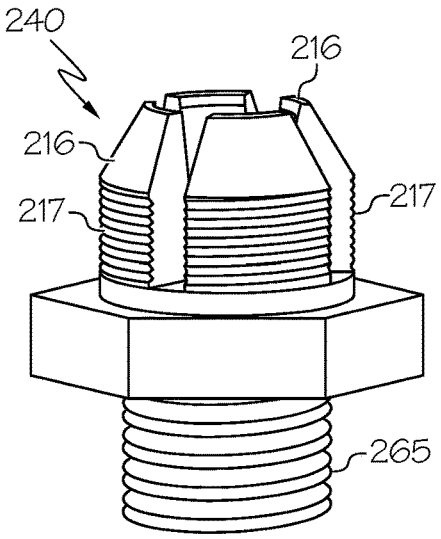
FIG. 7C is an enlarged perspective view of a perforated turret member shown in FIG. 7B.
Figure 8:
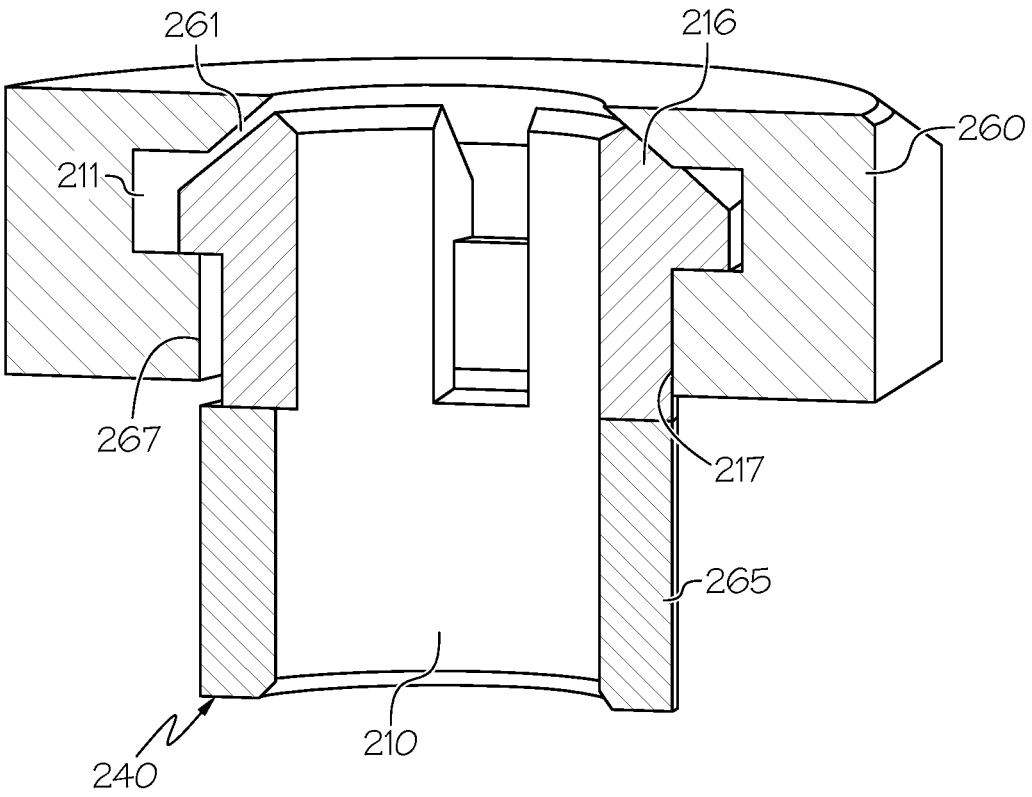
FIG. 8 is a schematic cross-sectional view of the turret portion and retaining nut of the tuning element of FIG. 7A.
Figure 9A:
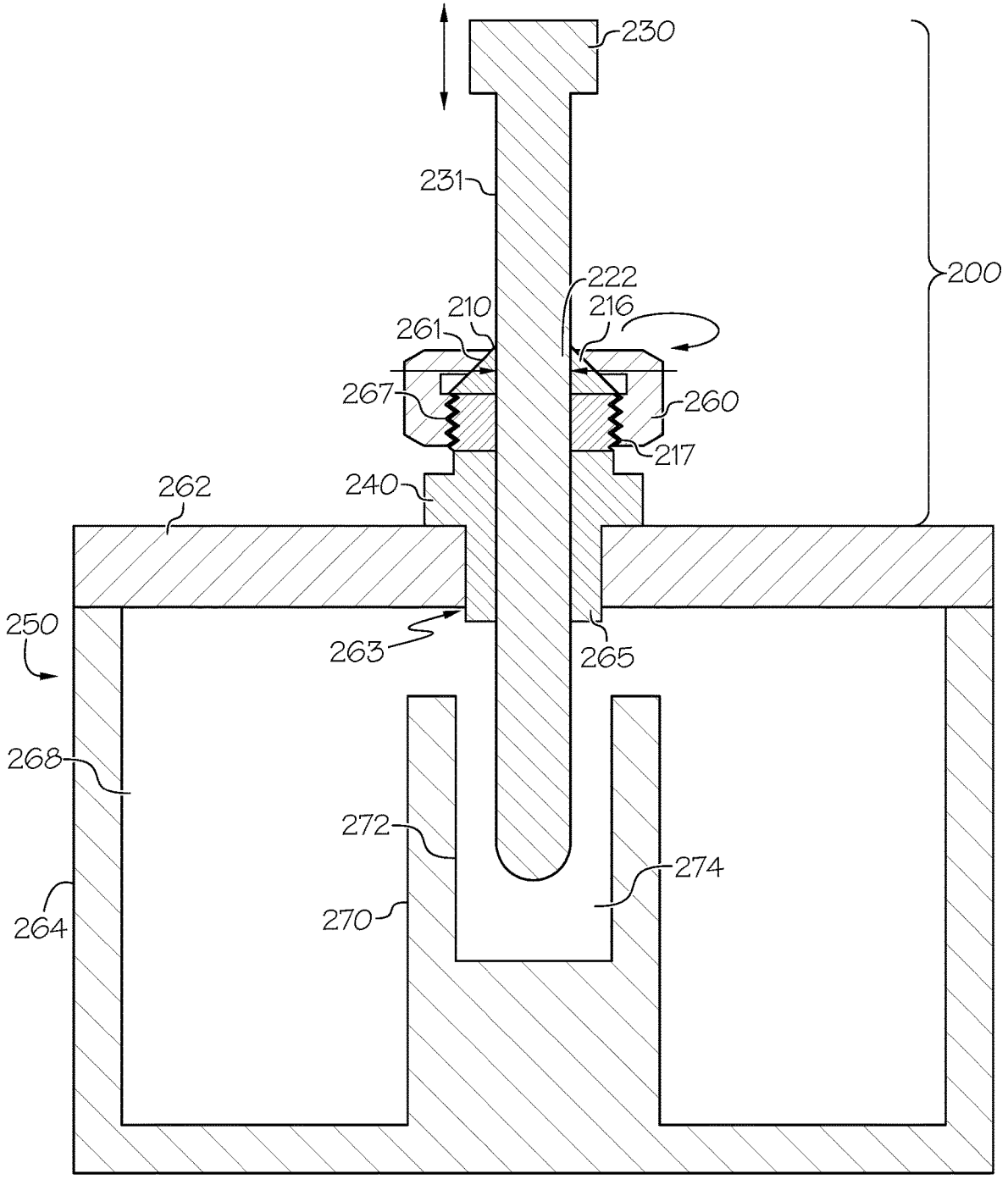
FIG. 9A is a cross-sectional view of the tuning element of FIG. 7A inserted into a top cover of and extending into a resonator of a resonant cavity filter of FIG. 6 in order to tune the frequency response of the filter.

FIGS. 6-9A illustrate a tuning element 200 according to embodiments of the present invention as well as a portion of a resonant cavity filter 250 that includes the tuning element 200. In particular, FIG. 6 is a perspective view of a resonant cavity filter including tuning elements 200 according to embodiments of the present invention. FIG. 7A is a perspective view of one of the tuning elements 200 of FIG. 6. FIG. 7B is an exploded view of the tuning element 200 of FIG. 7A. FIG. 7C is an enlarged perspective view of a perforated turret member 240 shown in FIG. 7B. FIG. 8 is a schematic cross-sectional view of the turret member 240 and retaining nut 260 of the tuning element 200 of FIG. 7A. FIG. 9A is a cross-sectional view of the tuning element 200 of FIG. 7A inserted into a top cover of and extending into a resonator 270 of one of the resonant cavity filters 250 of FIG. 6 in order to tune the frequency response of the filter 250.

Referring now to FIGS. 6 and 9A, the resonant cavity filter 250 includes a housing 264 that has a top cover 262. Screws 280 are used to tightly hold the top cover 262 in place. A plurality of resonators 270 such as, for example, metallic coaxial resonators, are disposed within cavities 268 of the filter 250. Each resonator 270 may have one or more sidewalls 272 (for example, a generally cylindrical shaped sidewall) that define an open interior 274. The top cover 262 includes a plurality of openings or apertures 263 that are aligned (e.g., coaxially aligned) with the interiors 274 of respective resonators 270. Tuning elements 200 are mounted on the top cover 262 for insertion (e.g., coaxial insertion) through the apertures 263 and into the interiors 274 of the respective resonators 270. Although described and illustrated herein primarily with reference to coaxial insertion of the tuning element into the resonator 270, it will be understood that the tuning element can be out of concentricity or even beside the resonator 270 and still provide the desired tuning effects described herein.

As shown FIGS. 7A, 7B, and 9A, the tuning element 200 includes an elongated pin member 230. In some embodiments, the pin member 230 may be a metallic rod that has a cylindrical shape so that an outer surface 231 thereof forms a single continuous sidewall. The pin member 230 includes a conductive material and has a contact portion 222 on the outer surface 231. The contact portion 222 refers to a portion of the outer surface 231 of the pin member 230 by which the pin member 230 is secured in a desired position to adjust a frequency response of the filter 250. For example, the pin member 230 may be secured by an interference or friction fit at the contact portion 222 via a clamping mechanism (as shown in the embodiments of FIGS. 6-10 and 16), a pinning mechanism (as shown in the embodiments of FIGS. 11-12), and/or an expansion/contraction mechanism (as shown in the embodiments of FIGS. 13-15 and 17). At least the contact portion 222 on the outer surface 231 of the pin member 230 is free of an external thread pattern (or "external threading"), such that the pin member 230 can be inserted through one of the apertures 263 and can be moved into and out of the interior 274 of the underlying resonator 270 to adjust the frequency response of the filter 250 without creating metal particles due to friction between threaded elements.

As shown in the embodiments of FIGS. 7A-7C, 8, and 9A, the tuning element 200 further includes a turret member 240 having an opening 210 therein that is aligned (e.g., coaxially aligned) with the interior 274 of the resonator 270. The opening 210 extends completely through the turret member 240 and has a diameter that is sufficient or is otherwise is sized to accept the pin member 230 and guide the pin member 230 into or out of the interior 274 of the resonator 270, e.g., by sliding the pin member 230 within the opening 210. A base 265 of the turret member 240 is sized to fit in the aperture 263 for mounting on the cover 262. The turret member 240 may be mounted on the top cover 262 by screw fit, press fit, soldering, or other mounting technique. When mounted by screw fit, the base 265 of the turret member 240 may include an external thread pattern that matches a thread pattern of the aperture 263 in the cover 262. However, the turret members 240 may be mounted on the top cover 262 before assembly with the remainder of the housing 264 or otherwise such that any metal particles created by the mounting of the turret member 240 on the top cover 262 may be prevented from entering or may be emptied from the interiors 274 of the resonators 270 before tuning by insertion of the pin members 230.

As shown in greater detail in FIGS. 7C, 8, and 9A, the turret member 240 includes a plurality of fingers 216 respectively positioned around a perimeter of the opening 210 therein. Although illustrated with reference to four fingers 216 by way of example, it will be understood that fewer or more fingers 216 may be included in some embodiments. The fingers 216 are flexible and/or elastic to grip the contact portion 222 of the pin member 230 therebetween, in order to secure the pin member 230 in the desired position to adjust the frequency response of the filter 250. For example, in the embodiments of FIGS. 7A-7C, 8, and 9A, the tuning element 200 includes a ring-shaped member (illustrated as an internally-threaded nut 260) having an inner surface 261 that is shaped to mate with outer surfaces of the fingers 216. Acceptance of the fingers 216 into the nut 260 (e.g., by tightening or otherwise moving the nut 260 towards the base 265 of the turret member 240) causes the fingers 216 to grip the contact portion 222 of the pin member 230 therebetween.

The outer surfaces of the fingers 216 may define a tapered shape, and the inner surface 261 of the nut 260 may be shaped to mate with the tapered shape of the fingers 216. In particular, as shown in greater detail in FIGS. 8 and 9A, outer surfaces of the fingers 216 respectively include an external thread pattern 217, and the nut 260 includes an internal thread pattern 267 on the inner surface 261 thereof that mates with the external thread pattern 217 of the fingers 216. That is, the fingers 216 include both a tapered portion and a threaded portion 217, and the inner surface 261 of the nut 260 includes a complementary tapered portion and threaded portion 267. In some embodiments, the tapered portion of the fingers 216 may define a width or diameter that is greater than the threaded portions 217. In some embodiments, the tapered portions and the threaded portions may be combined, that is, the tapered portions of the fingers 216 may include a thread pattern, and the inner surface 261 of the nut 260 may be correspondingly shaped for mating. The external thread pattern 217 of the fingers 216 is outside of the aperture 263 in the cover 262 and is otherwise not vertically aligned with the internal cavity 274 of the resonator 270.

As such, the turret member 240 may be secured or otherwise mounted to the cover 262 above the aperture 263 such that the opening 210 in the turret member 240 is aligned with the interior 274 of the resonator 270, and the pin member 230 may be inserted into the opening 210 in the turret member 240 and may be raised and lowered to extend different distances (or not at all) into the open interior 274 of the resonator 270 (illustrated by the up-and-down arrows in FIG. 9A) to a desired position to adjust the frequency response of the filter 250. The pin member 230 may be secured in the desired position by rotating the nut 260 (illustrated by the rotating arrow in FIG. 9A) such that the nut 260 tightens around the fingers 216 of the turret member 240, which deforms the fingers 216 to clamp the contact portion 222 of the outer surface 231 of the pin member 230 (illustrated by left and right arrows pointing toward the pin member 230 in FIG. 9A). The metal-to-metal contact created by the clamping mechanism 216, 260, which is free of internal threading aligned with the interior 274 of the resonator 270, may be advantageous in that deposition of metal particles into the interior 274 of the resonator 270 may be reduced and/or avoided when adjusting the position of the pin member 230 to tune the resonant filter 250.

Also, as the external thread pattern 217 of the fingers 216 is outside of the aperture 263 and is otherwise not vertically aligned with the internal cavity 274 of the resonator 270, any metal particles created by the rotational friction between the threading 267 on the internal surface 261 of the nut 260 and the external surfaces of the fingers 216 may not be introduced into the interior 274 of the resonator 270. That is, in some embodiments, the tuning element 200 may include an externally-threaded perforated turret member 240 with elastic fingers 216 that define a tapered shape around an opening or bore 211 therein, which can be used to mechanically fix a pin member 230 at a desired position by contact with a non-threaded contact portion 222 of the pin member 230.

As shown in FIGS. 8 and 9A, the outer diameter of the turret member 240 may be greater than the aperture 263 into the filter cavity 274, such that the external threading 217 of the turret member 240 is outside of or otherwise not adjacent to the interior of the filter cavity 274. A corresponding nut 260, internally tapered on inner surface 261 as well, can be screwed onto the turret member 240 to oblige the fingers 216 to move towards the internal opening 210 and secure the pin member 230 at a desired position in the opening 210 when the nut 260 is tightened. Such a configuration moves the threaded connection away from the openings 210, 263 that are aligned with the interior 274 of the resonator 270. This may help reduce or prevent metal shavings or debris that may be cut from the threading on the fingers 216 and/or nut 260 when the nut 260 is loosened or tightened from falling into the interior 274 of the resonant cavity filter 250, where such metal shavings or debris otherwise might serve as a source of PIM distortion.

Figure 9B:
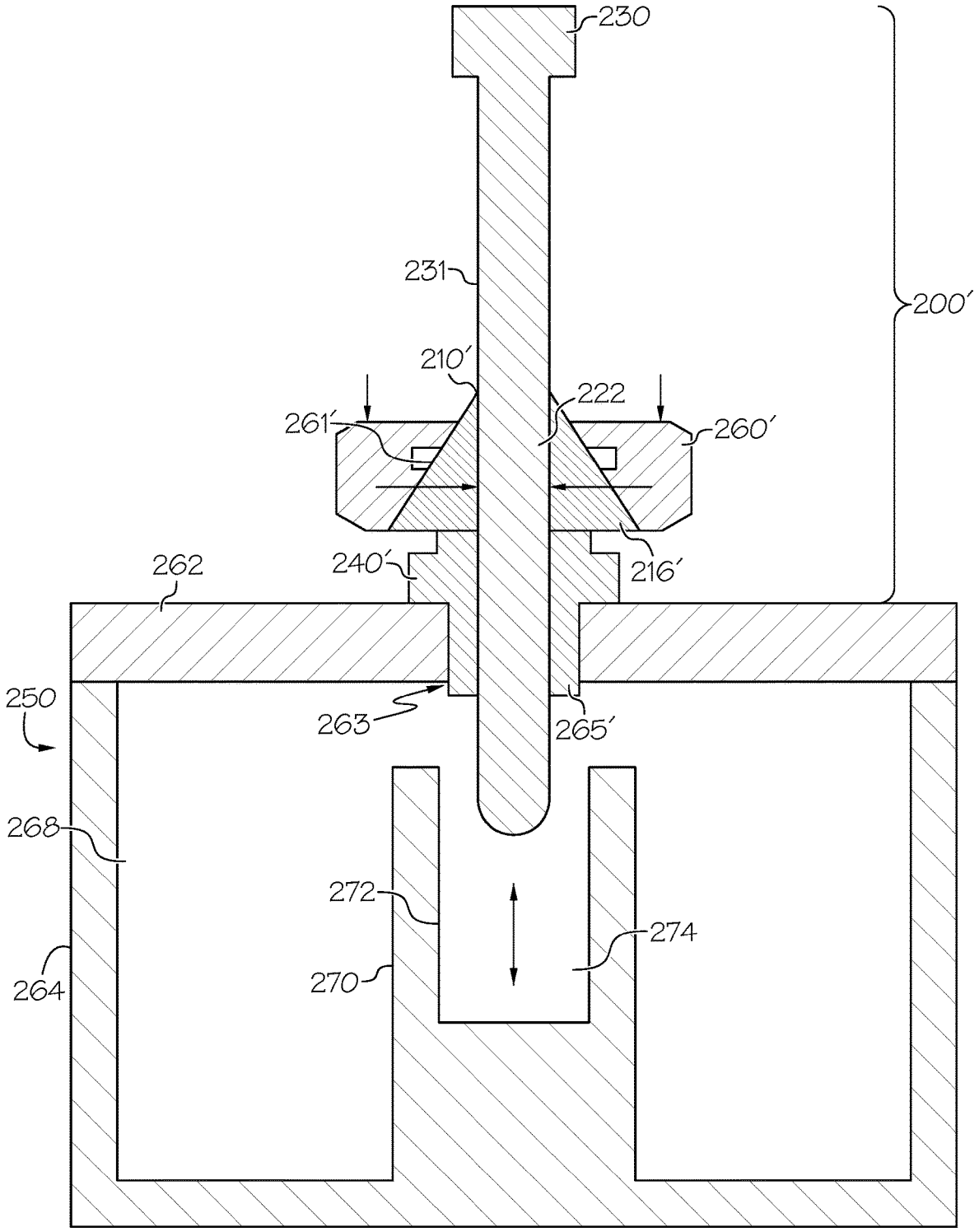
FIG. 9B is a cross-sectional view of a tuning element according to further embodiments of the present invention inserted into a top cover of and extending into a resonator of a resonant cavity filter in order to tune the frequency response of the filter.

FIG. 9B is a cross-sectional view of a tuning element 200' according to further embodiments of the present invention inserted into a top cover of and extending into a resonator of a resonant cavity filter in order to tune the frequency response of the filter. Referring now to FIG. 9B, and as similarly shown in FIG. 9A, the resonant cavity filter 250 includes a housing 264 that has a cover 262. A resonator 270 is disposed within a cavity 268 of the filter 250 and has one or more sidewalls 272 that define an open interior 274. The top cover 262 includes an opening or aperture 263, and a tuning element 200' is mounted on the top cover 262 for insertion (e.g., coaxial insertion) through the aperture 263 and into the interior 274 of the resonator 270. The tuning element 200' includes an elongated conductive pin member 230 having a contact portion 222 that is used to secure the pin member 230 in a desired position to adjust a frequency response of the filter 250. At least the contact portion 222 on the outer surface 231 of the pin member 230 is free of threading, such that the pin member 230 can be inserted through the aperture 263 and can be moved into and out of the interior 274 of the resonator 270 to adjust the frequency response of the filter 250 without creating metal particles due to friction between threaded elements.

As shown in the embodiments of FIG. 9B, the tuning element 200' further includes a turret member 240' having an opening 210' therein that is aligned (e.g., coaxially aligned) with the interior 274 of the resonator 270, with a diameter that is sufficient or is otherwise is sized to accept the pin member 230 and guide the pin member 230 into or out of the interior 274 of the resonator 270. A base 265' of the turret member 240' is sized to fit in the aperture 263 for mounting on the cover 262, and may be mounted on the cover 262 by screw fit, press fit, soldering, or other mounting technique, as similarly described above with reference to the turret member 240 of FIGS. 6-9A.

As shown in greater detail in FIG. 9B, the turret member 240' includes a plurality of fingers 216' respectively positioned around a perimeter of the opening 210' therein. The fingers 216' are flexible and/or elastic to grip the contact portion 222 of the pin member 230 therebetween, in order to secure the pin member 230 in the desired position to adjust the frequency response of the filter 250. That is, the turret member 240' may be similar in structure to the turret member 240 of FIG. 9A in some aspects. However, in contrast to the embodiments of FIG. 9A, the fingers 216' are free of threading on the outer surfaces thereof. The tuning element 200' further includes a ring-shaped member (also referred to herein as ring 260') having an inner surface 261' that is shaped to mate with outer surfaces of the fingers 216'. The outer surfaces of the fingers 216' may define a tapered shape. At least one of the ring 260' or the fingers 216' has an elasticity that is sufficient such that acceptance of the fingers 216' into the ring 260' (e.g., by pushing or otherwise moving the ring 260' towards the base 265' of the turret member 240') causes the fingers 216' to grip the contact portion 222 of the pin member 230 therebetween.

As such, the turret member 240' may be secured or otherwise mounted to the top cover 262 above the aperture 263 such that the opening 210' in the turret member 240' is aligned with the interior 274 of the resonator 270, and the pin member 230 may be inserted into the opening 210' in the turret member 240' and may be raised and lowered to extend different distances (or not at all) into the open interior 274 of the resonator 270 (illustrated by the up-and-down arrows in FIG. 9B) to a desired position to adjust the frequency response of the filter 250. The pin member 230 may be secured in the desired position by pushing the ring 260' (illustrated by the down arrow in FIG. 9B) toward the base 265' of the turret 240' such that the ring 260' deforms the fingers 216' to clamp the contact portion 222 of the outer surface of the pin member 230 (illustrated by left and right arrows pointing toward the pin member 230). In some embodiments, the fingers 216' may define an annular groove on the outer surfaces thereof, and the nut 260' may include an annular ring on the inner surface 261' thereof (or vice versa).

That is, in some embodiments, the tuning elements 200' may include a perforated turret 240' having non-threaded, tapered elastic fingers 216'. A corresponding elastic ring 260', internally tapered and non-threaded as well, can be pushed onto the turret 240' to accept the fingers 216' and oblige the fingers 216' to move towards the internal opening 210' to fix the inserted pin member 230 in a desired position. The metal-to-metal contact created by the clamping mechanism 216', 260' at the contact portion 222, which is free of a threading pattern aligned with the interior 274 of the resonator 270, may be advantageous in that deposition of metal particles into the interior 274 of the resonator 270 may be reduced and/or avoided when adjusting the position of the pin member 230 to tune the resonant filter 250.

Figure 10A:
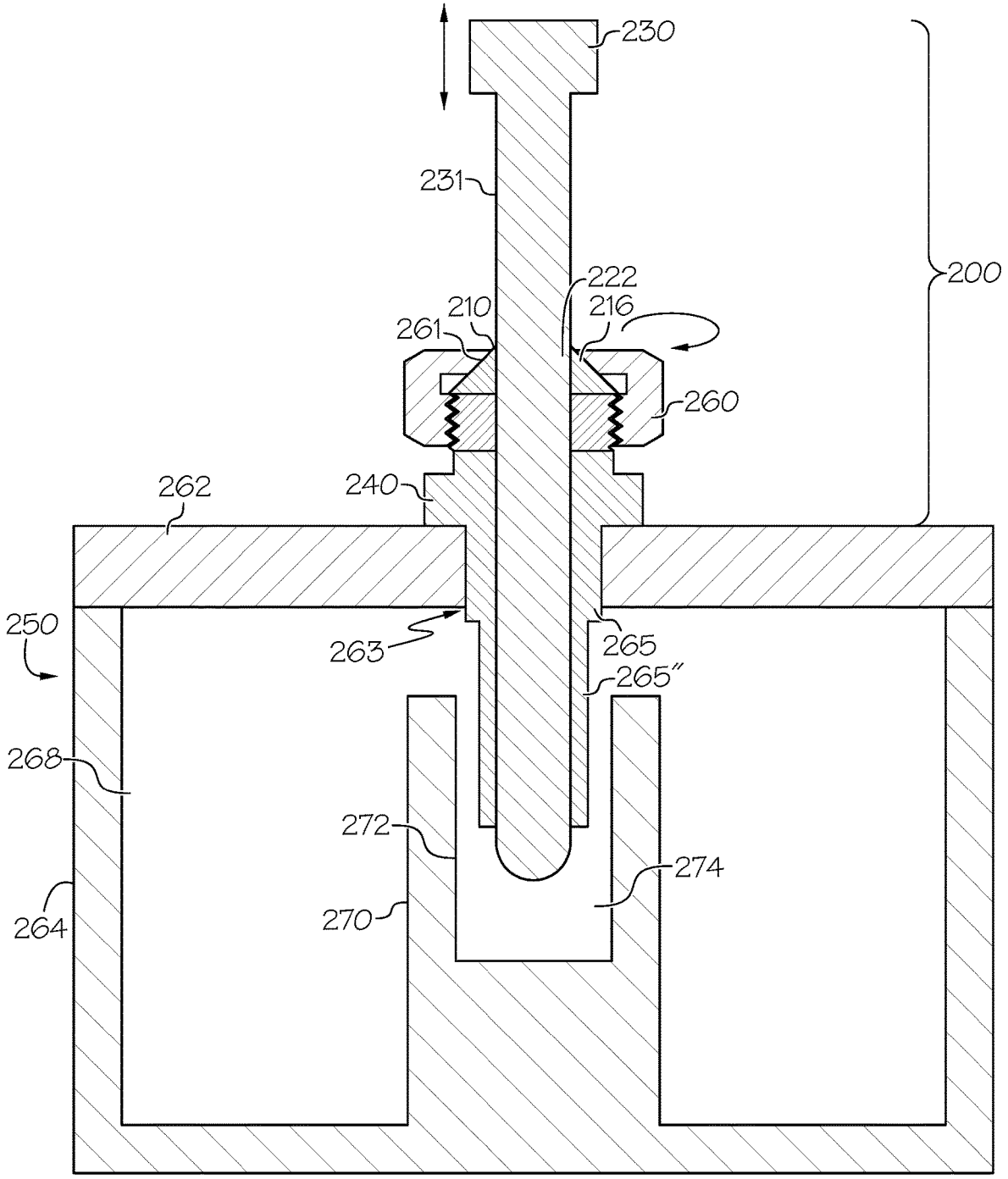
FIG. 10A is a cross-sectional view of a tuning element according to further embodiments of the present invention inserted into a top cover of and extending into a resonator of a resonant cavity filter in order to tune the frequency response of the filter.
Figure 10B:
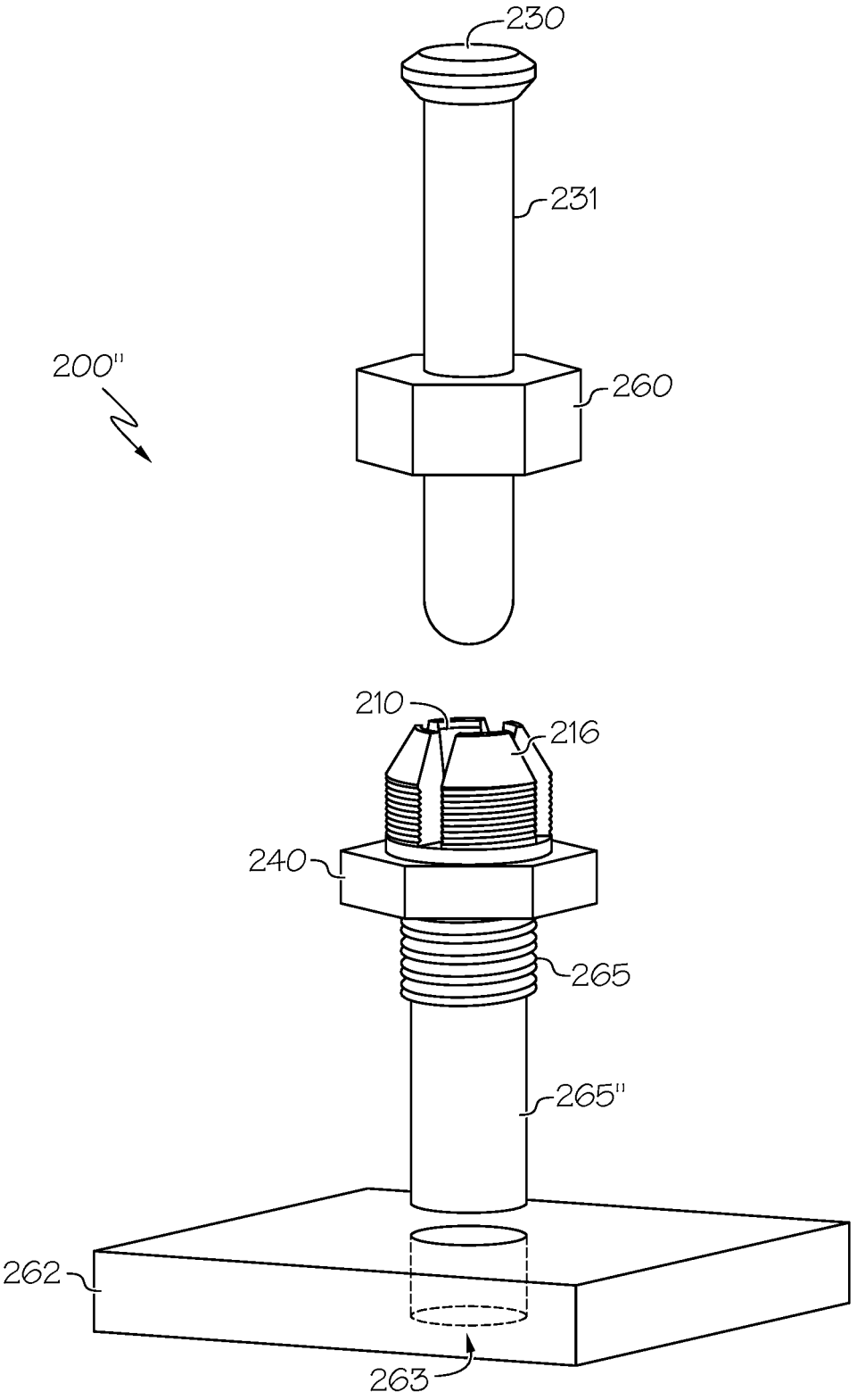
FIG. 10B is an exploded perspective view of the tuning element of FIG. 10A.
Figure 11:
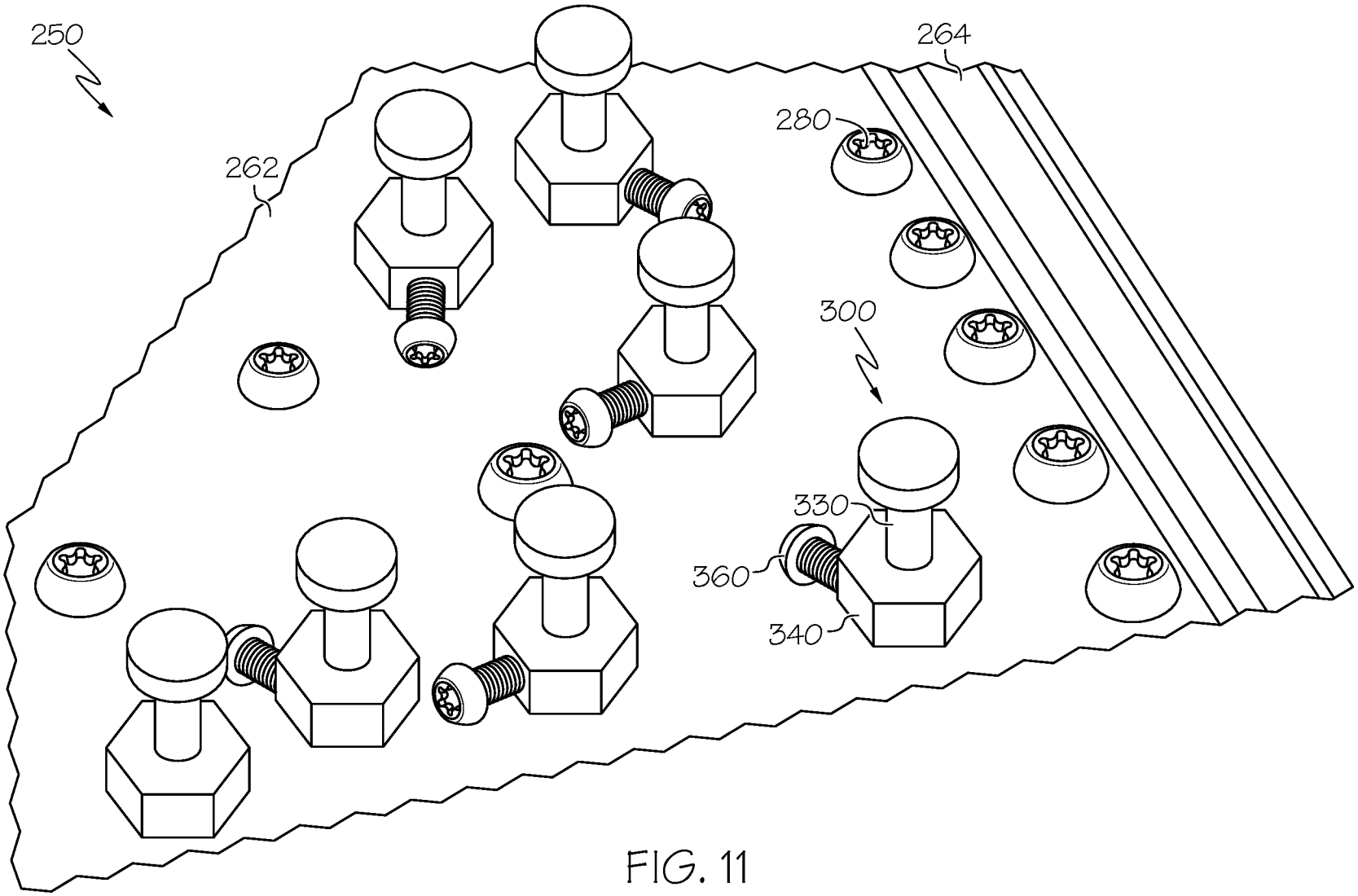
FIG. 11 is a perspective view of a resonant cavity filter including tuning elements according to still further embodiments of the present invention.

FIG. 10A is a cross-sectional view of a tuning element 200" according to further embodiments of the present invention inserted into a top cover 262 of and extending into a resonator 270 of a resonant cavity filter 250 in order to tune the frequency response of the filter 250. FIG. 10B is an exploded perspective view of the tuning element 200' of FIG. 10A. As shown in FIGS. 10A and 10B, the arrangement of elements and clamping mechanism is similar to that of the tuning element 200 of FIG. 9A, and as such, repeated description thereof will be omitted. However, in FIGS. 10A and 10B, the base 265 of the turret 240 further includes an extended base portion 265" that extends through and beyond the aperture 262 in the top cover and into the filter 250. In some embodiments, the extended base portion 265" may protrude into the interior 274 of the resonator 270. As such, in the embodiments of FIGS. 10A-10B, the tuning effect provided by the tuning element 200" may attributed primarily to the extended base portion 265", while additional or fine tuning may be attributed to adjustment of the pin member 230 into or out of the resonator 270. Such a tuning element 200" may provide improved RF stability in addition to the improved PIM performance as discussed above.

Figure 12A:
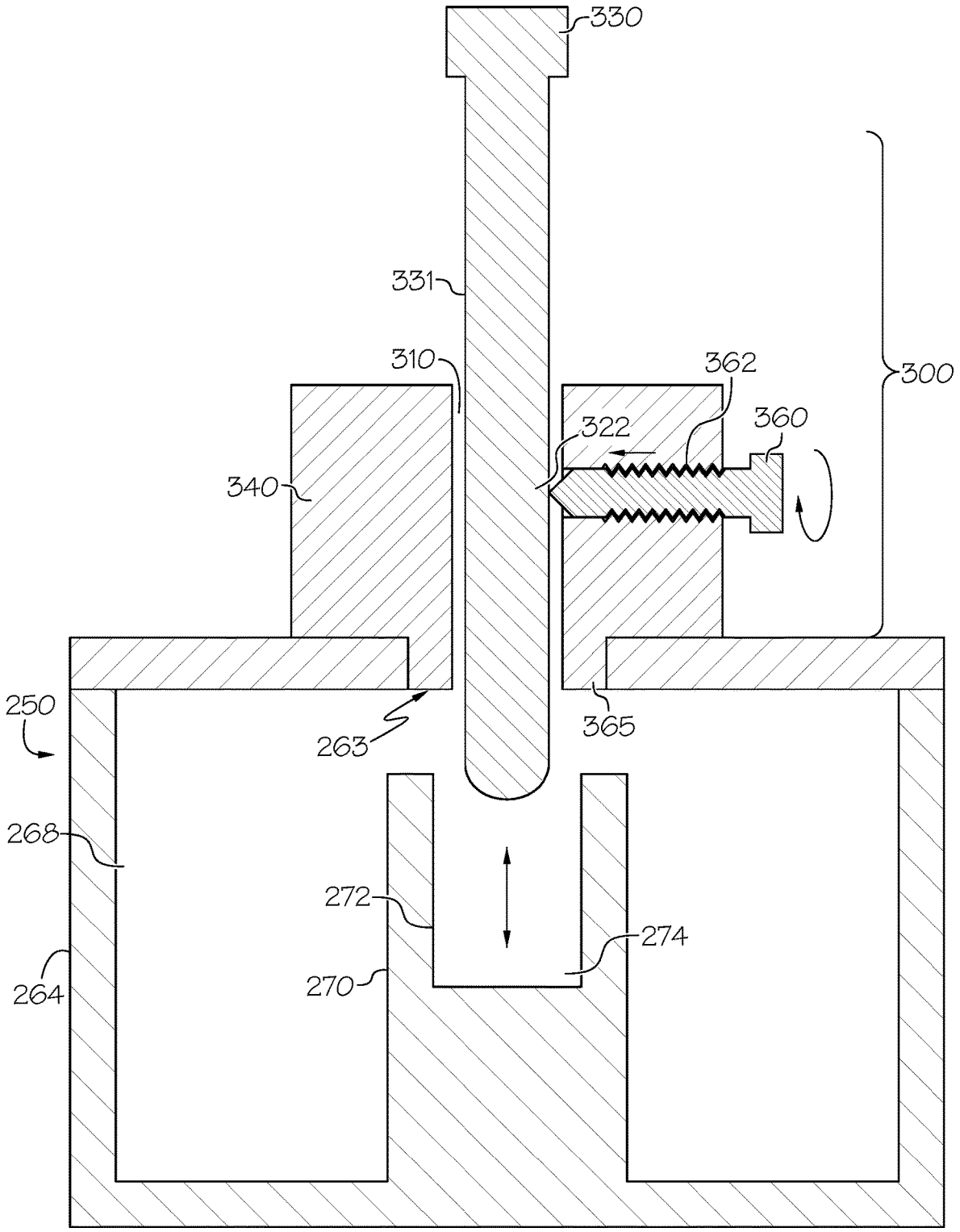
FIG. 12A is a cross-sectional view of the tuning element of FIG. 11 inserted into a top cover of and extending into a resonator of a resonant cavity filter in order to tune the frequency response of the filter.
Figure 12B:
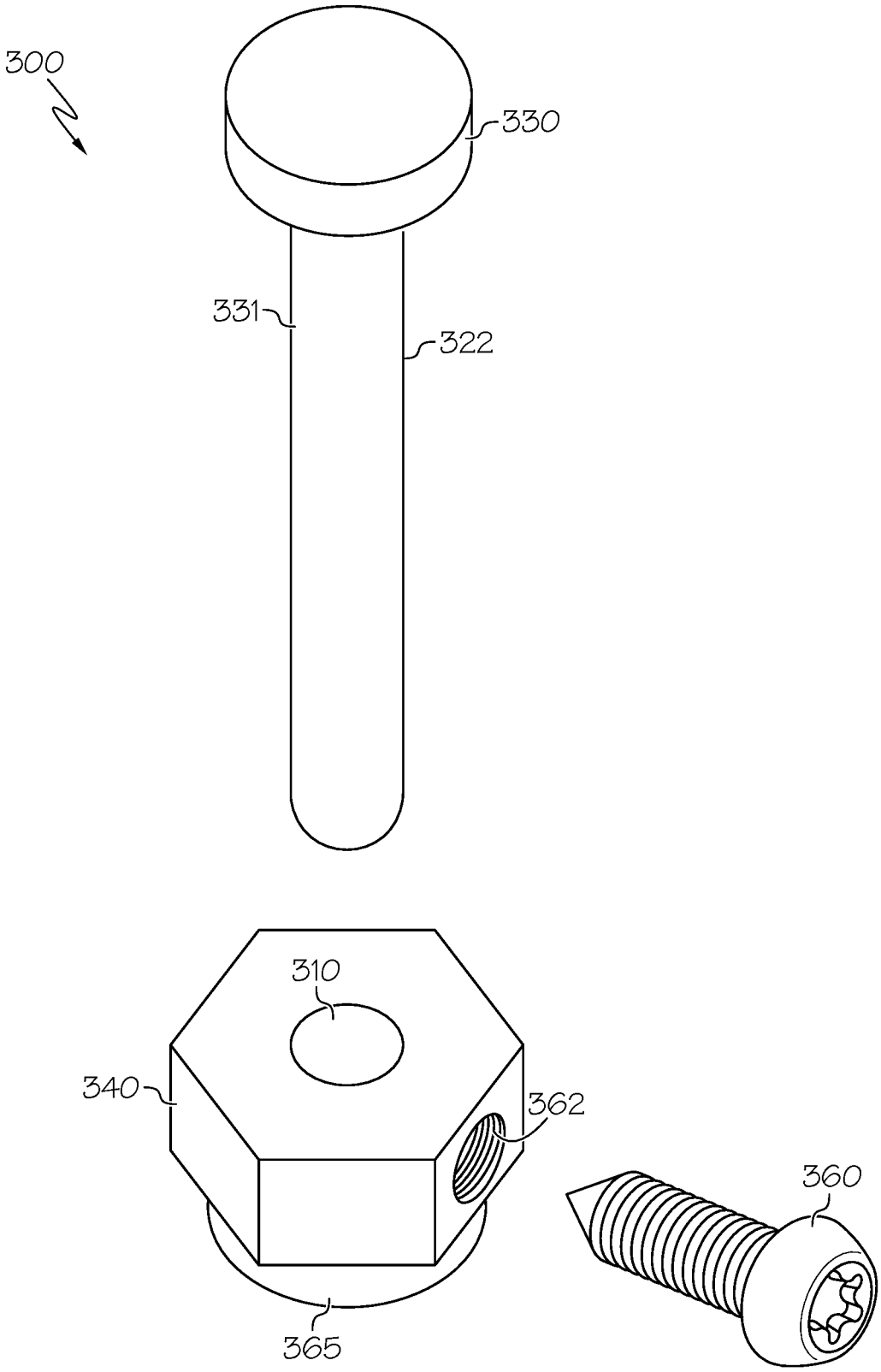
FIG. 12B is an exploded perspective view of the tuning element of FIG. 12A.

FIG. 11 is a perspective view of a resonant cavity filter 250 including tuning elements 300 according to still further embodiments of the present invention. FIG. 12A is a cross-sectional view of the tuning element 300 of FIG. 11 inserted into a top cover of and extending into a resonator of a resonant cavity filter 250 in order to tune the frequency response of the filter. FIG. 12B is an exploded view of the tuning element 300 of FIG. 12A.

As shown in FIGS. 11 and 12A-12B, the resonant cavity filter 250 includes a housing 264 that has a top cover 262. A resonator 270 such as, for example, a metallic coaxial resonator, is disposed within a cavity 268 of the filter 250. The resonator 270 may have one or more sidewalls 272 (for example, a generally cylindrical shaped sidewall) that define an open interior 274. The top cover 262 includes an opening or aperture 263 that is aligned (e.g., coaxially aligned) with the interior 274 of the resonator 270.

A tuning element 300 is mounted on the top cover 262 for insertion (e.g., coaxial insertion) through the aperture 263 and into the interior 274 of the resonator 270. The tuning element 300 includes an elongated pin member 330. The pin member 330 includes a conductive material and has a contact portion 322 on its outer surface 331 that is used to secure the elongated pin member 330 in a desired position to adjust a frequency response of the filter 250. At least the contact portion 322 on the outer surface 331 of the pin member 330 is free of threading, such that the pin member 330 can be inserted through the aperture 263 and can be moved into and out of the interior 274 of the resonator 270 to adjust the frequency response of the filter 250 without creating metal particles due to friction between threaded elements.

The tuning element 300 further includes a turret member 340 having an opening 310 therein that is aligned with the interior 274 of the resonator 270. The opening 310 extends completely through the turret member 340 and has a diameter that is sufficient or is otherwise sized to accept the pin member 330 and guide the pin member 330 into or out of the interior 274 of the resonator 270, e.g., by sliding the pin member 330 within the opening 310. The opening 310 may be free of internal threading. A base 365 of the turret member 340 is sized to fit in the aperture 263 for mounting on the cover 262. The turret member 340 may be mounted on the cover 262 by screw fit, press fit, soldering, or other mounting technique, as similarly described above with reference to the turret members 240 and 240' of FIGS. 9 and 10.

As shown in FIGS. 11 and 12A-12B, the turret member 340 includes a threaded hole 362 in a sidewall thereof, which is sized and otherwise configured to accept a laterally-extending screw-shaped member 360 (also referred to herein as a fixing screw). That is, the threading of the threaded hole 362 mates with the threading of the screw-shaped member 360. The screw-shaped member 360 is thus configured to be laterally threaded into the threaded hole 362 to contact a contact portion 322 of the pin member 330 and mechanically fix the pin member 330 in the desired position (e.g., by tightening or otherwise moving the fixing screw 360 through the threaded hole 362 to contact the pin member 330). For example, the fixing screw 360 may wedge or pin the contact portion 322 of the pin member 330 between an end of the fixing screw 360 and a sidewall of the opening 310 in the turret member 340. The laterally threaded hole 362 may be inclined (rather than extending parallel) with respect to the surface of the top cover 262 in some embodiments, for example, inclined toward or away from the top cover 262. Similar to the embodiments of FIGS. 6-10, at least the contact portion 322 of the pin member 330 does not include or is otherwise free of threading on the outer surface 331.

As such, the turret member 340 may be secured or otherwise mounted to the cover 262 above the aperture 263 such that the opening 310 in the turret member is aligned with the interior 274 of the resonator 270, and the pin member 330 may be inserted into the opening 310 in the turret member 340 and may be raised and lowered to extend different distances (or not at all) into the open interior 274 of the resonator 270 (illustrated by the up-and-down arrows in FIG. 12A) to a desired position to adjust the frequency response of the filter 250. The pin member 330 may be secured in the desired position by rotating the fixing screw 360 (illustrated by the rotating arrow in FIG. 12) such that the fixing screw 360 moves toward and contacts the pin member 330 at the contact portion 322 (illustrated by the arrow pointing toward the pin member 330 in FIG. 12). The metal-to-metal contact created by the pinning mechanism between the contact portion 322 of pin member 330 and the laterally-extending fixing screw 360 (and/or the sidewalls of the opening 310) may be advantageous in that deposition of metal particles into the interior 274 of the resonator 270 may be reduced and/or avoided when adjusting the position of the pin member 330 to tune the resonant filter 250.

That is, as the thread patterns of the threaded hole 362 and the fixing screw 360 are outside of the aperture 263 and are otherwise not vertically aligned with the internal cavity 274 of the resonator 270, metal particles created by the rotational friction between the threading of the threaded hole 362 and the fixing screw 360 may be reduced or may not be introduced into the interior 274 of the resonator 270. Accordingly, as with the embodiments of FIGS. 6-10, the embodiments of FIGS. 11 and 12A-12B thus provide configurations that move the threading of the turret member 340 outside of or otherwise not adjacent to the interior of the filter cavity 274, which may help reduce or prevent metal shavings or debris that may be cut from the threading on threaded hole 362 and the fixing screw 360 when the fixing screw 360 is loosened or tightened from falling into the interior 274 of the resonant cavity filter 250.

Figure 13A:
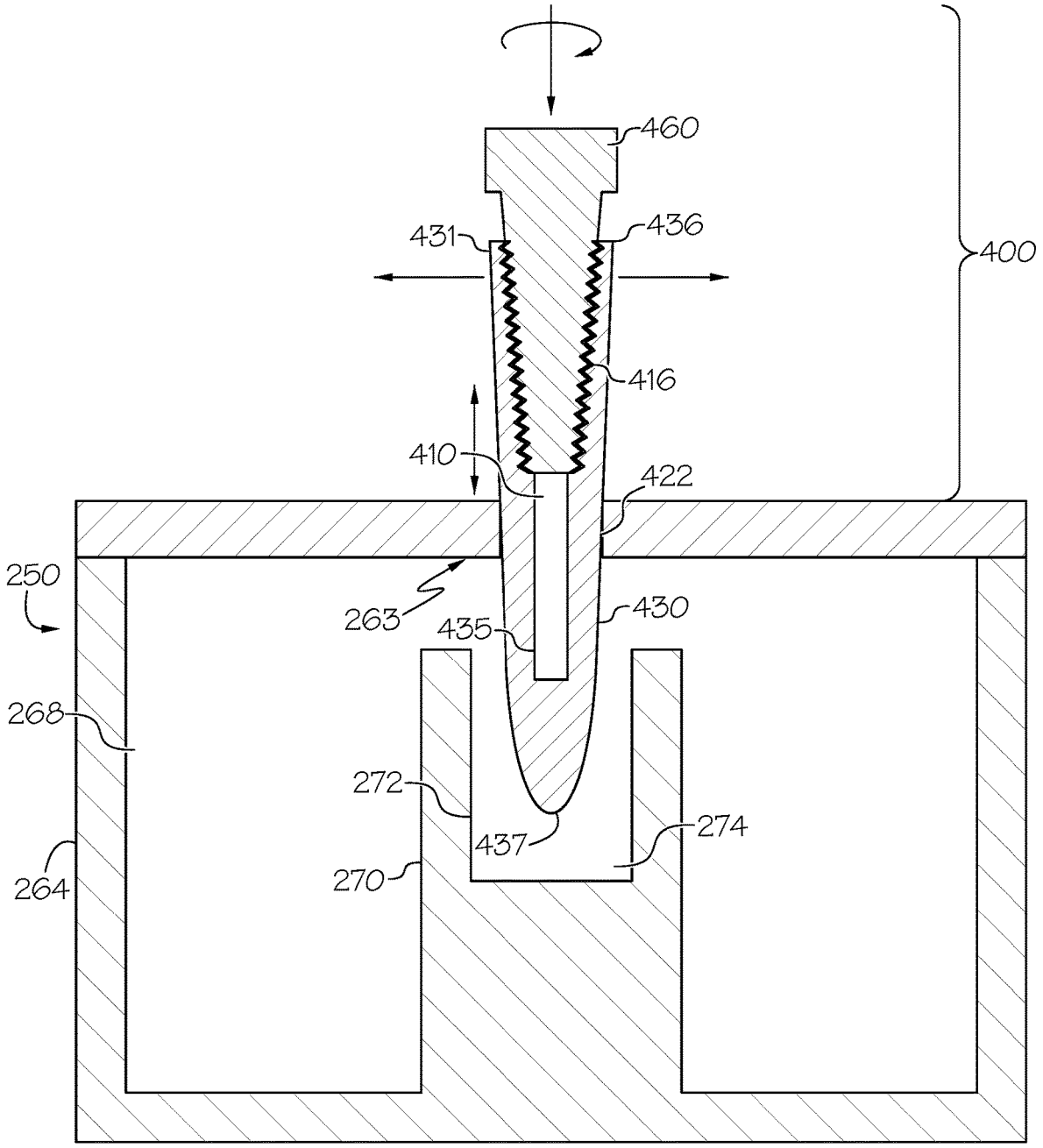
FIG. 13A is a cross-sectional view of a tuning element according to yet further embodiments of the present invention inserted into a top cover of and extending into a resonator of a resonant cavity filter in order to tune the frequency response of the filter.
Figure 13B:
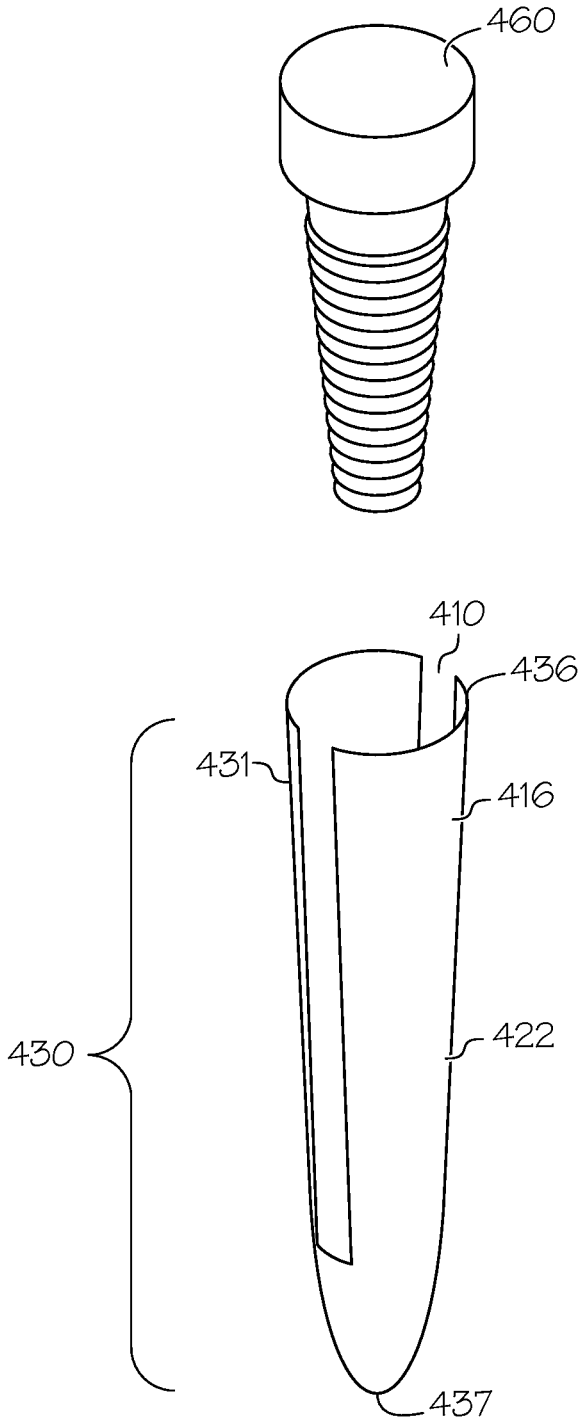
FIG. 13B is an exploded perspective view of the tuning element of FIG. 13A.

FIG. 13A is a cross-sectional view of a tuning element 400 according to yet further embodiments of the present invention inserted into a top cover 262 of and extending into a resonator 270 of a resonant cavity filter 250 in order to tune the frequency response of the filter. FIG. 13B is an exploded view of the tuning element 400 of FIG. 13A. As shown in FIGS. 13A-13B, and as similarly shown in FIGS. 9, 10, and 12, the resonant cavity filter 250 includes a housing 264 that has a top cover 262. A resonator 270 is disposed within a cavity 268 of the filter 250 and has one or more sidewalls 272 that define an open interior 274. The top cover 262 includes an opening or aperture 263 that is aligned (e.g., coaxially aligned) with the interior 274 of the resonator 270.

A tuning element 400 is mounted on the top cover 262 for insertion (e.g., coaxial insertion) through the aperture 263 and into the interior 274 of the resonator 270. The tuning element 400 includes an elongated conductive pin member 430 having a contact portion 422 on an outer surface 431 thereof that is used to secure the pin member 430 in a desired position to adjust a frequency response of the filter 250. At least the contact portion 422 on the outer surface 431 of the pin member 430 is free of threading, such that the pin member 430 can be inserted through the aperture 263 and can be moved into and out of the interior 274 of the resonator 270 to adjust the frequency response of the filter 250 without creating metal particles due to friction between threaded elements.

As shown in greater detail in FIGS. 13A-13B, the elongated pin member 430 of the tuning element 400 includes a hollow opening 410 extending along a major axis of the pin member 430. The hollow opening 410 extends within the conductive outer surface 431 of the pin member 430, from an upper end or head portion 436 of the pin member 430 along the major axis. At least a portion of the upper end 436 of the pin member 430 is slotted 435 or otherwise configured such that sidewalls thereof define fingers 416 having sufficient flexibility or elasticity to expand or vary a diameter of the pin member 430 responsive to insertion of another member into the hollow opening 410.

In the example of FIGS. 13A-13B, the hollow opening 410 is sized and otherwise configured to accept a screw-shaped member 460. The hollow opening 410 includes an internal thread pattern that is configured to mate with a thread pattern of the screw-shaped member 460. The hollow opening 410 is tapered (e.g., has a varying diameter such that an area of a transverse cross-section of one portion exceeds an area of a transverse cross-section of another portion) along the major axis of the elongated pin member 430 toward a lower end 437, such that insertion of the screw-shaped member 460 into the hollow opening 410 causes expansion of the contact portion 422 at the fingers 416 of the conductive outer surface 431 to contact the sidewall of the aperture 263, with sufficient expansion force and friction to secure the pin member 430 in the desired position. That is, the pin member 430 may be a slotted expansion pin in some embodiments, where the position of the screw-shaped member 460 in the hollow opening 410 will determine an expansion of the fingers 416 at the sidewalls, and thus the interference fit or blockage of the pin member 430 in the aperture 263.

As such, the pin member 430 may be inserted into the aperture 263 in the cover 262 and may be raised and lowered to extend different distances (or not at all) into the open interior 274 of the resonator 270 (illustrated by the up-and-down arrows in FIG. 13A) to a desired position to adjust the frequency response of the filter 250, e.g., by sliding the pin member 430 within the aperture 263. The pin member 430 may be secured in the desired position by rotating the screw-shaped member 460 (illustrated by the rotating arrow in FIG. 13A) such that the screw-shaped member 460 moves toward the lower end of the pin member 430 (illustrated by the downward arrow in FIG. 13A), which deforms the fingers 416 to expand the outer surface 431 of the pin member 430 such that the contact portion 422 contacts the sidewalls of the aperture 263 in the cover 262 (illustrated by left and right arrows pointing away from the pin member 430 in FIG. 13A). The metal-to-metal contact created by the expansion mechanism 416, 460 between the contact portion 422 (which is free of a threading pattern) and the sidewall of the aperture 263 may be advantageous in that deposition of metal particles into the interior 274 of the resonator 270 may be reduced and/or avoided when adjusting the position of the pin member 430 to tune the resonant filter 250. Also, an end 437 of the elongated pin member 430 opposite the hollow opening 410 is closed, such that any metal particles created by the rotational friction between the threading on the internal surface of the opening 410 and the external surfaces of the screw-shaped member 460 may not be introduced into the interior 274 of the resonator 270.

In some embodiments, a head portion of the screw elements 360, 460 may include one or more slots, openings, protrusions or other mating structures 214 that are designed to cooperate with a tool for purposes of rotating the screws 360, 460. For example, the head portion of the screw elements 360 and/or 460 may include a female mating structure such as a slot that is configured to receive the end of a regular screwdriver, a pair of crossed slots that are configured to receive the end of a Phillips screwdriver, a square or hexagonal aperture that is designed to receive an end of an Allen wrench, a star shaped cavity that is configured to receive an end of a Torx tool, etc. In contrast, a head portion of the elongated pin members 230, 330, 430 described herein may be free of slots or other mating structures.

Figure 14A:
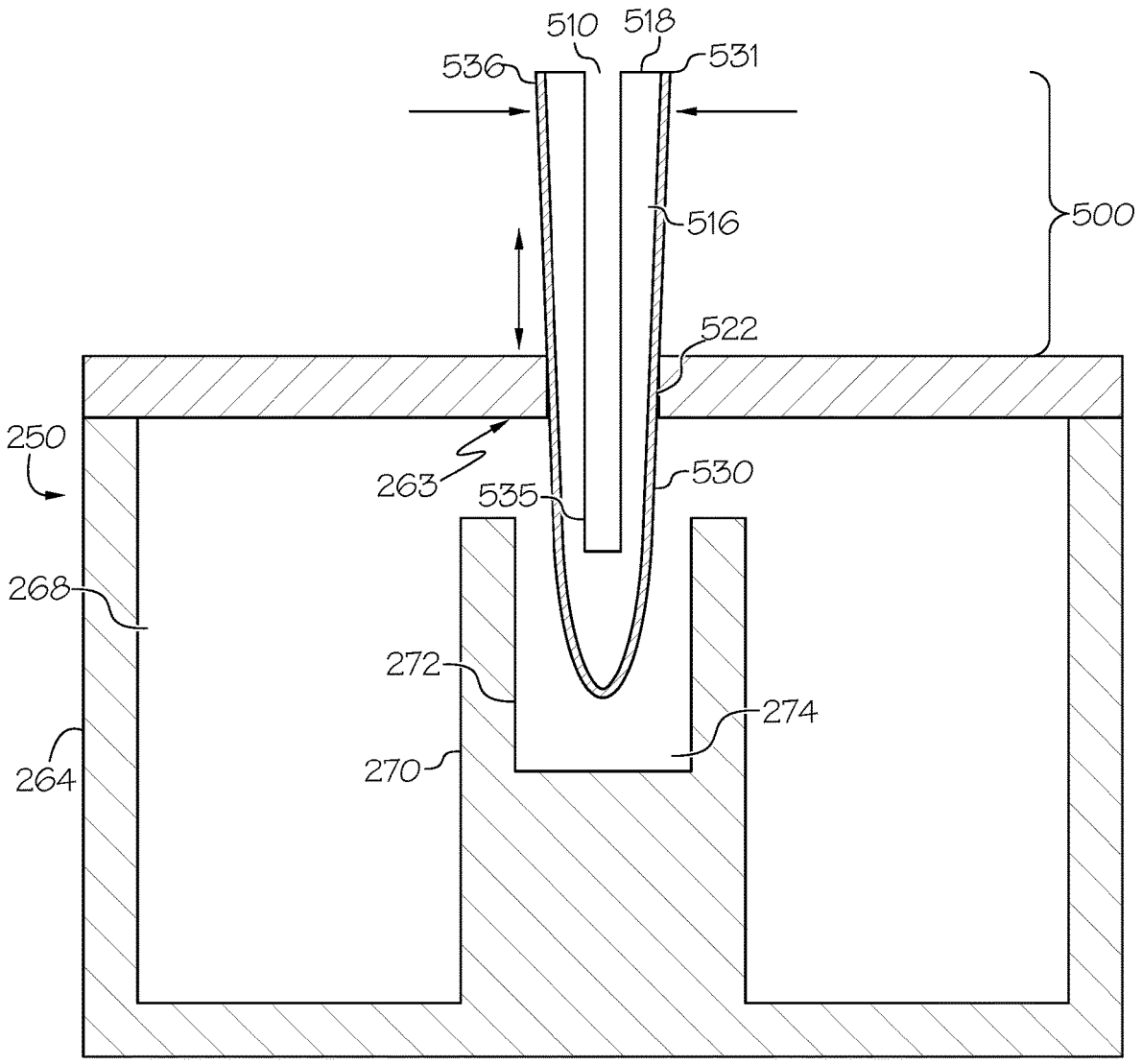
FIG. 14A is a cross-sectional view of a tuning element according to further embodiments of the present invention inserted into a top cover of and extending into a resonator of a resonant cavity filter in order to tune the frequency response of the filter.
Figure 14B:
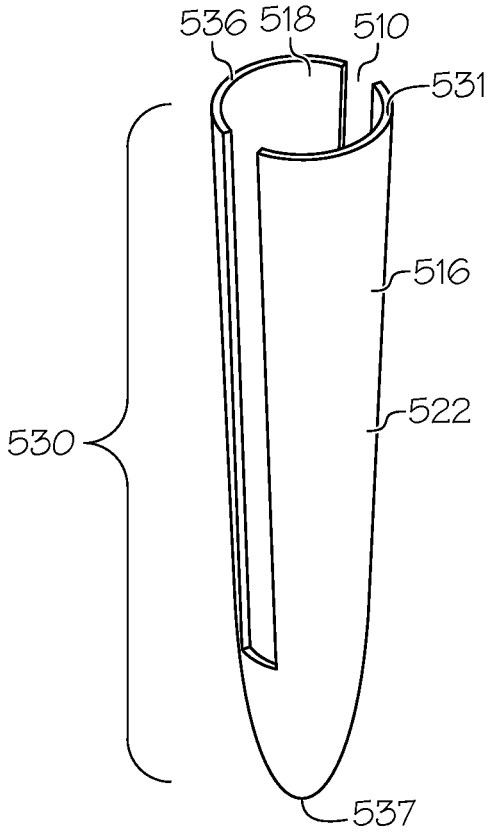
FIG. 14B is perspective view of the tuning element of FIG. 14A.

FIG. 14A is a cross-sectional view of a tuning element according to further embodiments of the present invention inserted into a top cover 262 of and extending into a resonator 270 of a resonant cavity filter 250 in order to tune the frequency response of the filter 250. FIG. 14B is a perspective view of the tuning element 500 of FIG. 14A. As shown in FIG. 14, and as similarly shown in FIGS. 9, 10, 12, and 13, the resonant cavity filter 250 includes a housing 264 that has a cover 262. A resonator 270 is disposed within a cavity 268 of the filter 250 and has one or more sidewalls 272 that define an open interior 274. The top cover 262 includes an opening or aperture 263.

A tuning element 500 is mounted on the top cover 262 for insertion (e.g., coaxial insertion) through the aperture 263 and into the interior 274 of the resonator 270. The tuning element 500 includes an elongated pin member 530 having a contact portion 522 that is used to secure the pin member 530 in a desired position to adjust a frequency response of the filter 250. At least the contact portion 522 on the conductive outer surface 531 of the pin member 530 is free of threading, such that the pin member 530 can be inserted through the aperture 263 and can be moved into and out of the interior 274 of the resonator 270 to adjust the frequency response of the filter 250 without creating metal particles due to friction between threaded elements.

As shown in greater detail in FIGS. 14A-14B, the elongated pin member 530 of the tuning element 500 includes an elastic inner portion 518 defining a hollow opening 510 and including the conductive outer surface 531 thereon. The outer surface 531 of the pin member 530 may be a metal or other layer having sufficient or desired conductivity, while the inner portion 518 of the pin member 530 may be plastic or other material having sufficient or desired elasticity. The hollow opening 510 extends within the elastic inner portion 518 of the pin member 530 from an upper end or head portion 536 of the pin member 530 along the major axis. The elastic inner portion 518 may comprise a tubular structure concentrically arranged within and surrounded by the conductive outer surface 531. The lower end 537 of the tubular structure may or may not be open.

At least a portion of the upper end 536 of the pin member 530 is slotted 535 or otherwise configured to define fingers 516 having sufficient flexibility or elasticity to vary a diameter of the pin member 530 for insertion into the aperture 263. More particularly, the elastic inner portion 518 has sufficient flexibility to be compressed during insertion of the pin member 530 into the aperture 263, and to be expanded responsive to release of the compression to contact the sidewall of the aperture 263 to secure the pin member 530 in the desired position.

That is, the tuning element 500 may include a pin member 530 with elastic, compressible fingers 516 that define a diameter that is larger than the aperture 263 in the cover 262 of the filter housing 264. Compression of the fingers 516 (illustrated by left and right arrows pointing toward the opening 510 in FIG. 14A) deforms the outer surface 531 of the pin member 530 to be smaller than a diameter of the aperture 263, such that the pin member 530 can be moved into or out of the aperture 263 (illustrated by up-and-down arrows in FIG. 14A), e.g., by sliding the pin member 530 within the aperture 263. Releasing the compression of the fingers 516 expands the outer surface 531 of the pin member 530 to be greater than the diameter of the aperture 263, such that the contact portion 522 contacts the sidewalls of the aperture 263 in the top cover 262, and the pin member 530 may be fixed in a desired position by the expansion force and friction fit with the sidewalls of the aperture 263. The metal-to-metal contact between the contact portion 522 (which is free of a threading pattern) and the sidewall of the aperture 263 created by the expansion mechanism 516 may be advantageous in that deposition of metal particles into the interior 274 of the resonator 270 may be reduced and/or avoided when adjusting the position of the pin member 530 to tune the resonant filter 250.

Figure 15A:
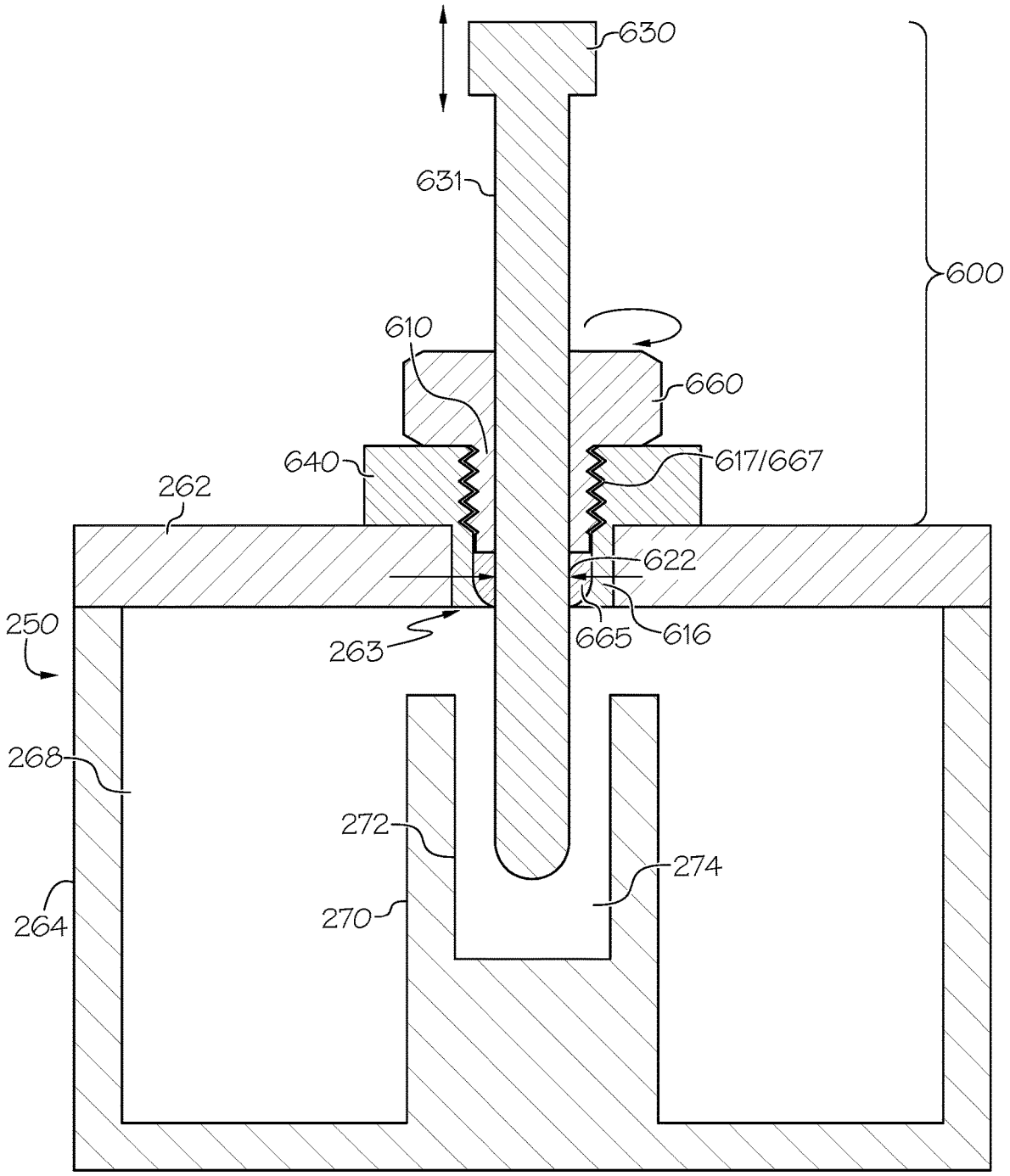
FIG. 15A is a cross-sectional view of a tuning element according to further embodiments of the present invention inserted into a top cover of and extending into a resonator of a resonant cavity filter in order to tune the frequency response of the filter.
Figure 15B:
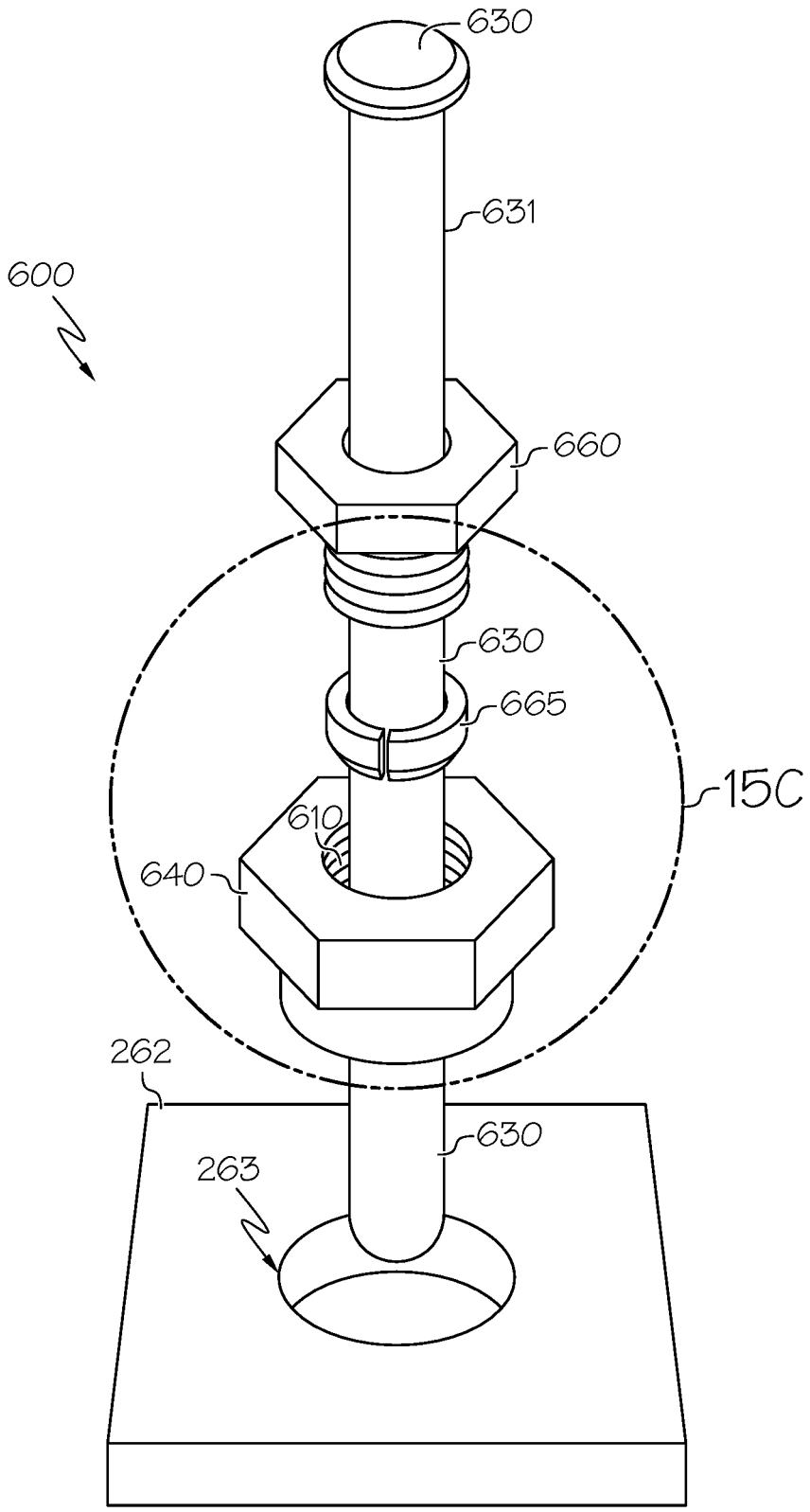
FIG. 15B is perspective view of the tuning element of FIG. 15A.
Figure 15C:
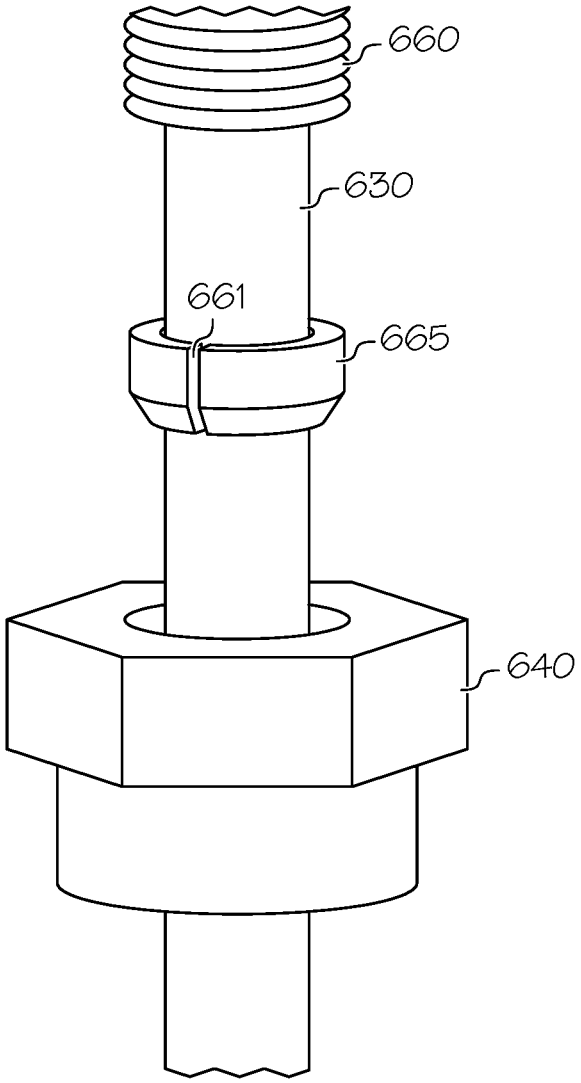
FIG. 15C is an enlarged perspective view of the tuning element of FIG. 15B.

FIG. 15A is a cross-sectional view of a tuning element 600 according to further embodiments of the present invention inserted into a top cover 262 of and extending into a resonator 270 of a resonant cavity filter 250 in order to tune the frequency response of the filter 250. FIG. 15B is perspective view of the tuning element 600 of FIG. 15A. FIG. 15C is an enlarged perspective view of the tuning element 600 of FIG. 15B.

As shown in FIGS. 15A-15C, the resonant cavity filter 250 includes a housing 264 that has a cover 262. A resonator 270 is disposed within a cavity 268 of the filter 250 and has one or more sidewalls 272 that define an open interior 274. The top cover 262 includes an opening or aperture 263. A tuning element 600 is mounted on the top cover 262 for insertion (e.g., coaxial insertion) through the aperture 263 and into the interior 274 of the resonator 270. The tuning element 600 includes an elongated pin member 630 having a contact portion 622 that is used to secure the pin member 630 in a desired position to adjust a frequency response of the filter 250. At least the contact portion 622 on the conductive outer surface 631 of the pin member 630 is free of threading, such that the pin member 630 can be inserted through the aperture 263 and can be moved into and out of the interior 274 of the resonator 270 to adjust the frequency response of the filter 250 without creating metal particles due to friction between threaded elements.

The tuning element 600 further includes a turret member 640 having an opening 610 therein that is aligned (e.g., coaxially aligned) with the interior 274 of the resonator 270, with a diameter that is sufficient or is otherwise is sized to accept the nut 660. The nut 660 includes an opening therein that is sufficient or otherwise sized to accept and guide the pin member 630 into or out of the interior 274 of the resonator 270. A base 616 of the turret member 640 is sized to fit in the aperture 263 for mounting on the cover 262, and may be mounted on the cover 262 by screw fit, press fit, soldering, or other mounting technique, as similarly described above with reference to the turret member 240 of FIGS. 6-9A.

Still referring to FIGS. 15A-15C, the opening 610 in the turret member 640 has an internal thread pattern 617 and is tapered toward the interior 274 of the resonator 270. The nut 660 includes a lower end that is sized to fit within the opening 610 and has an external thread pattern 667 that is configured to mate with the internal thread pattern 617. The tuning element 600 also includes a compressible ring 665 having a diameter sized to fit within the opening 610 in the turret member 640. The compressible ring 665 may include a slot or cut 661 therein, which may allow the diameter of the compressible ring 665 to vary responsive to force. The elongated pin member 630 extends through the compressible ring 665 and the nut 660 for insertion into the interior 274 of the resonator 270. Tightening of the nut 660 advances the compressible ring 665 toward the interior 274 of the resonator 270. As the compressible ring 665 is advanced toward the interior 274 of the resonator 270, the tapered opening 610 in the turret member 640 causes contraction of the compressible ring 665 against the contact portion 622 of the pin member 630 to secure the pin member 630 in the desired position.

For example, in some embodiments the compressible ring 665 may be a conic shaped elastic ring. The turret member 640 may be a perforated and threaded bush or bushing that is mounted into the aperture 263 in the filter cover 262, the nut 660 and the elastic ring 665 can be inserted on the pin 630, and the pin member 630 (including the nut 660 and the ring 665 thereon) can be inserted into the opening 610 in the bush 640 and raised or lowered to extend different distances (or not at all) into the open interior 274 of the resonator 270 (as shown by the up-and-down arrows in FIG. 15A) to adjust the frequency response of the filter 250. As the internal surface in the opening 610 of the bush 640 is tapered (for example, also conic shaped) toward the interior 274 of the resonator 270, the nut 660 can be screwed into the opening 610 in the bush 640 thus pressing the elastic ring 665 in the conic seat at the base 616 of the bush 640, forcing the elastic ring 665 against the contact surface 622 of the pin member 630. Since the elastic ring 665 has the slot or cut 661 therein, its diameter can be reduced as it is compressed around the pin member 630, and the pin member 630 may be fixed in a desired position by the compression force and friction fit. The metal-to-metal contact between the contact portion 622 (which is free of a threading pattern) and the ring 665 created by the compression or clamping mechanism 661, 610 may be advantageous in that deposition of metal particles into the interior 274 of the resonator 270 may be reduced and/or avoided when adjusting the position of the pin member 630 to tune the resonant filter 250. Also, the compressible ring 665 and/or the tapered shape of the opening 610 in the turret member 640 may reduce and/or prevent any metal particles created from rotational friction between the thread patterns 617 and 667 from entering the interior 274 of the resonator.

Figure 16A:
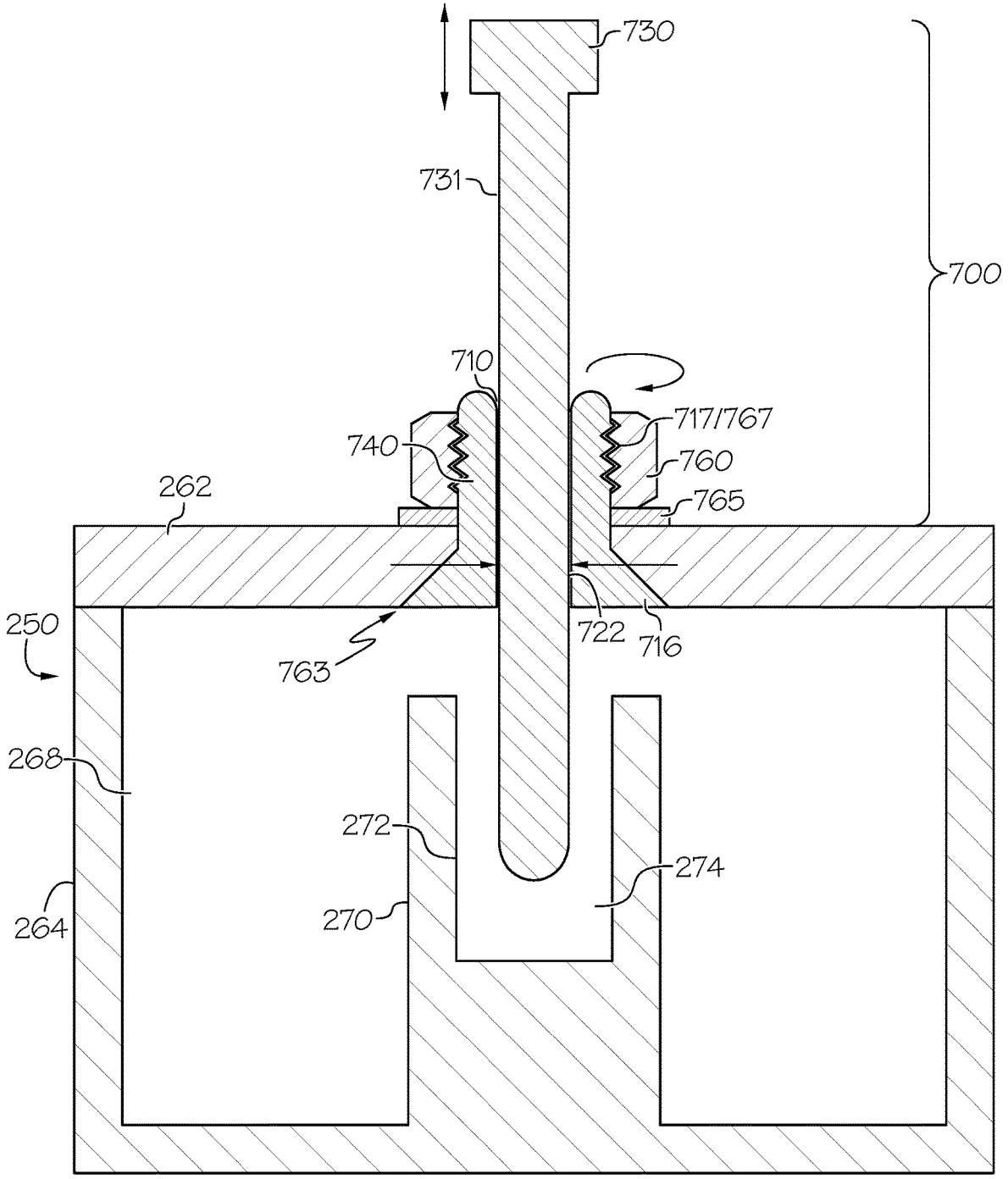
FIG. 16A is a cross-sectional view of a tuning element according to further embodiments of the present invention inserted into a top cover of and extending into a resonator of a resonant cavity filter in order to tune the frequency response of the filter.
Figure 16B:
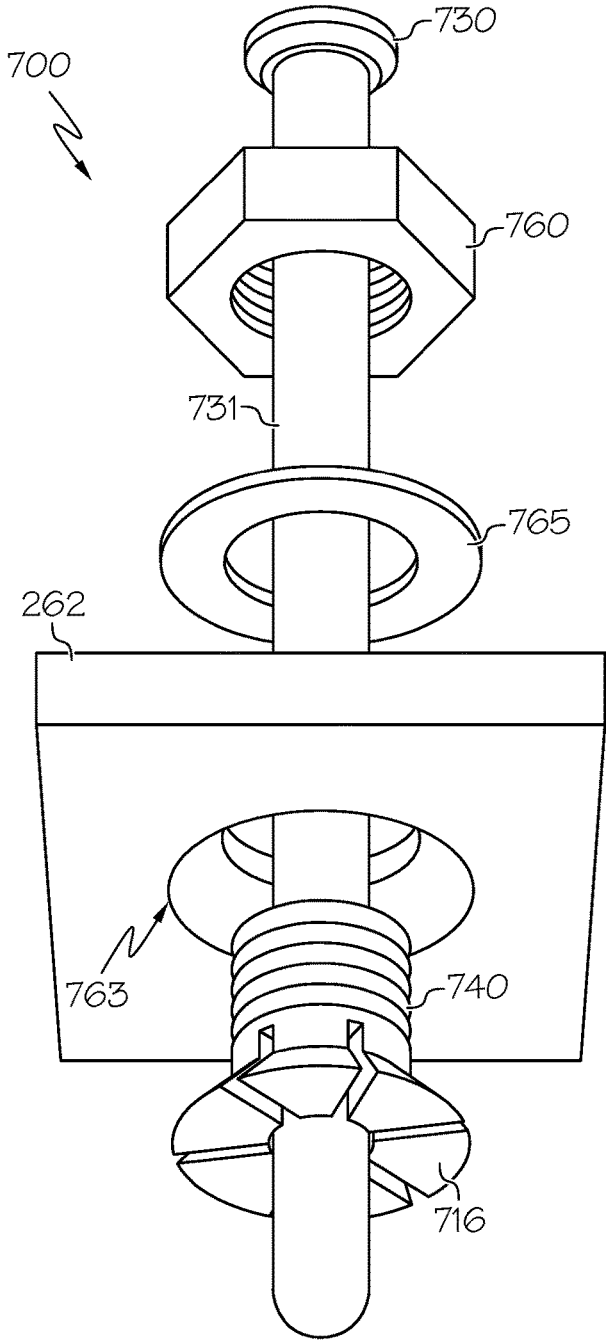
FIG. 16B is perspective view of the tuning element of FIG. 16A.
Figure 16C:
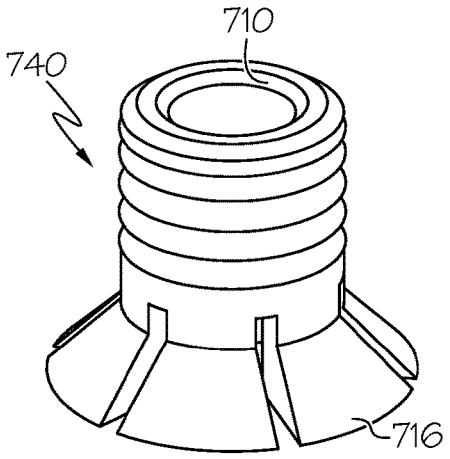
FIG. 16C is an enlarged perspective view of the turret member of FIG. 16B.

FIG. 16A is a cross-sectional view of a tuning element 700 according to further embodiments of the present invention inserted into a top cover 262 of and extending into a resonator 270 of a resonant cavity filter 250 in order to tune the frequency response of the filter 250. FIG. 16B is perspective view of the tuning element 700 of FIG. 16A. FIG. 16C is an enlarged perspective view of the turret member 740 of FIGS. 16A-16B.

As shown in FIG. 16A, the resonant cavity filter 250 includes a housing 264 that has a cover 262. A resonator 270 is disposed within a cavity 268 of the filter 250 and has one or more sidewalls 272 that define an open interior 274. The top cover 262 includes an opening or aperture 763. A tuning element 700 is mounted on the top cover 262 for insertion (e.g., coaxial insertion) through the aperture 763 and into the interior 274 of the resonator 270. The tuning element 700 includes an elongated pin member 730 having a contact portion 722 that is used to secure the pin member 730 in a desired position to adjust a frequency response of the filter 250, where at least the contact portion 722 on the conductive outer surface 731 of the pin member 730 is free of threading such that the pin member 730 can be inserted through the aperture 763 and can be moved into and out of the interior 274 of the resonator 270 to adjust the frequency response of the filter 250 without creating metal particles due to friction between threaded elements.

As shown in FIGS. 16A-16C, the aperture 763 in the top cover 262 is tapered in a direction away from the interior 274 of the resonator 270. The tuning element 700 further includes a turret member 740 having an opening 710 therein that is aligned (e.g., coaxially aligned) with the interior 274 of the resonator 270. The opening 710 extends completely through the turret member 740 and has a diameter that is sufficient or is otherwise is sized to accept and guide the pin member 730 into or out of the interior 274 of the resonator 270, e.g., by sliding the pin member 730 within the opening 710. The turret member 740 includes a plurality of petals or fingers 716 respectively positioned around a perimeter of the opening 710 therein. For example, a base of the turret member 740 may be tapered and slotted to define fingers 716 that are shaped to mate with the shape of the tapered aperture 763 in the top cover 262. The fingers 716 are flexible and/or elastic to grip the contact portion 722 of the pin member 730 therebetween, in order to secure the pin member 730 in the desired position to adjust the frequency response of the filter 250.

For example, in the embodiments of FIGS. 16A-16C, the tuning element 700 further includes a nut 760 having an internal thread pattern 767 that is shaped to mate with an external thread pattern 717 of the turret member 740, which protrudes outside of the aperture 763 opposite the resonator 270. The nut 760 can be loosened around the external thread pattern such that the pin member 730 may be freely raised and lowered to extend different distances (or not at all) into the open interior 274 of the resonator 270 (illustrated by the up-and-down arrows in FIG. 16A) to adjust the frequency response of the filter 250. Tightening the nut 760 (illustrated by the rotating arrow in FIG. 16A) on the external thread pattern 717 of the turret member 740 causes acceptance of the fingers 716 into the tapered aperture 763, forcing the fingers 716 towards the pin member 730 to clamp the contact portion 722 of the outer surface 731 therebetween and secure the pin member 730 in a desired position. The metal-to-metal contact between the contact portion 722 (which is free of a threading pattern) and the turret member 740 created by the clamping mechanism 716, 760 may be advantageous in that deposition of metal particles into the interior 274 of the resonator 270 may be reduced and/or avoided when adjusting the position of the pin member 730 to tune the resonant filter 250. Also, as the external thread pattern 717 of the turret member 740 is outside of the aperture 763, any metal particles created by the rotational friction between the threading 767 on the internal surface of the nut 760 and the external surfaces of the turret member 740 may not be introduced into the interior 274 of the resonator 270. A washer 765 may also be provided between the nut 760 and the top cover 262 to block the external thread pattern 717 from the interior of the filter 250.

Figure 17A:
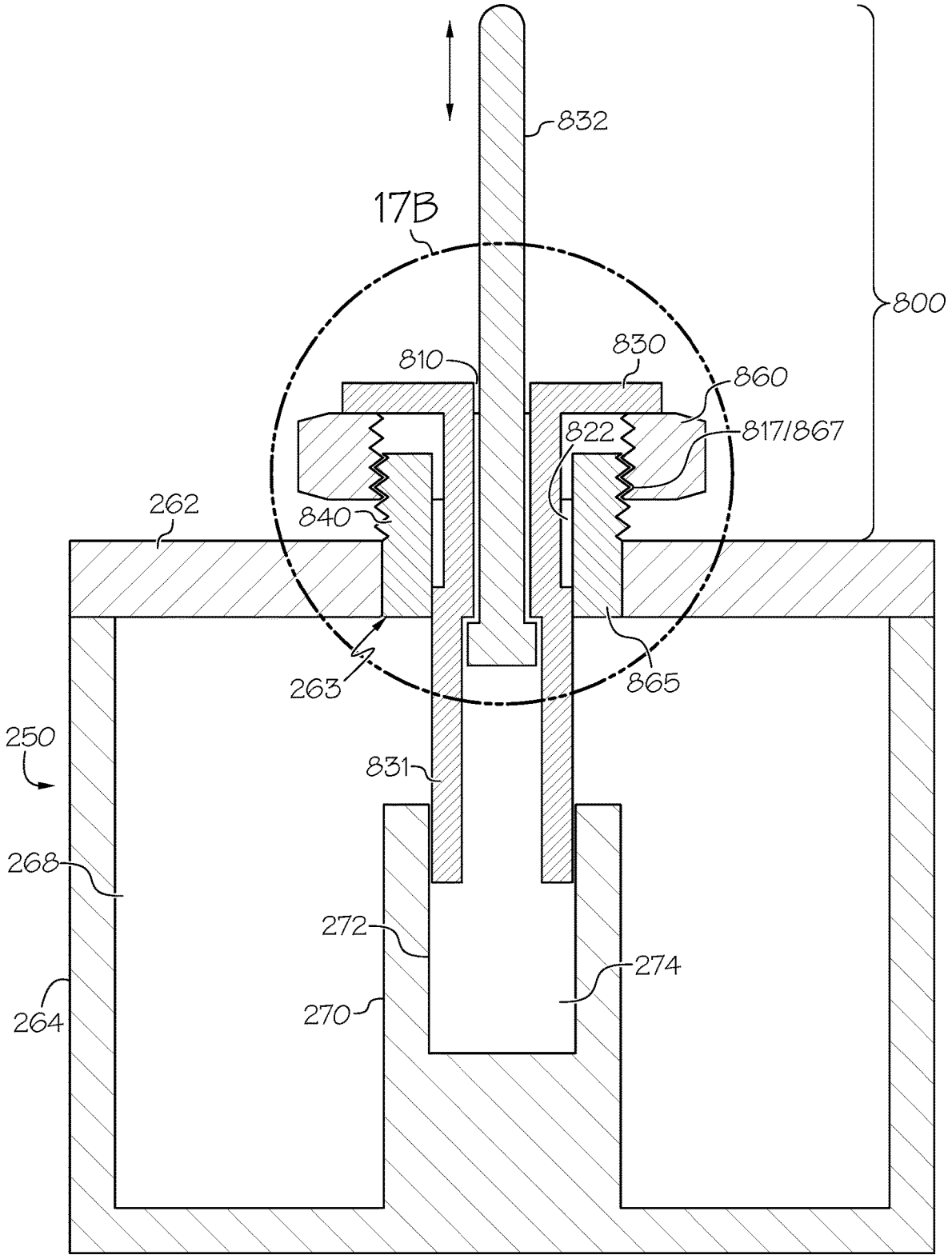
FIG. 17A is a cross-sectional view of a tuning element according to further embodiments of the present invention inserted into a top cover of and extending into a resonator of a resonant cavity filter in order to tune the frequency response of the filter.
Figure 17B:
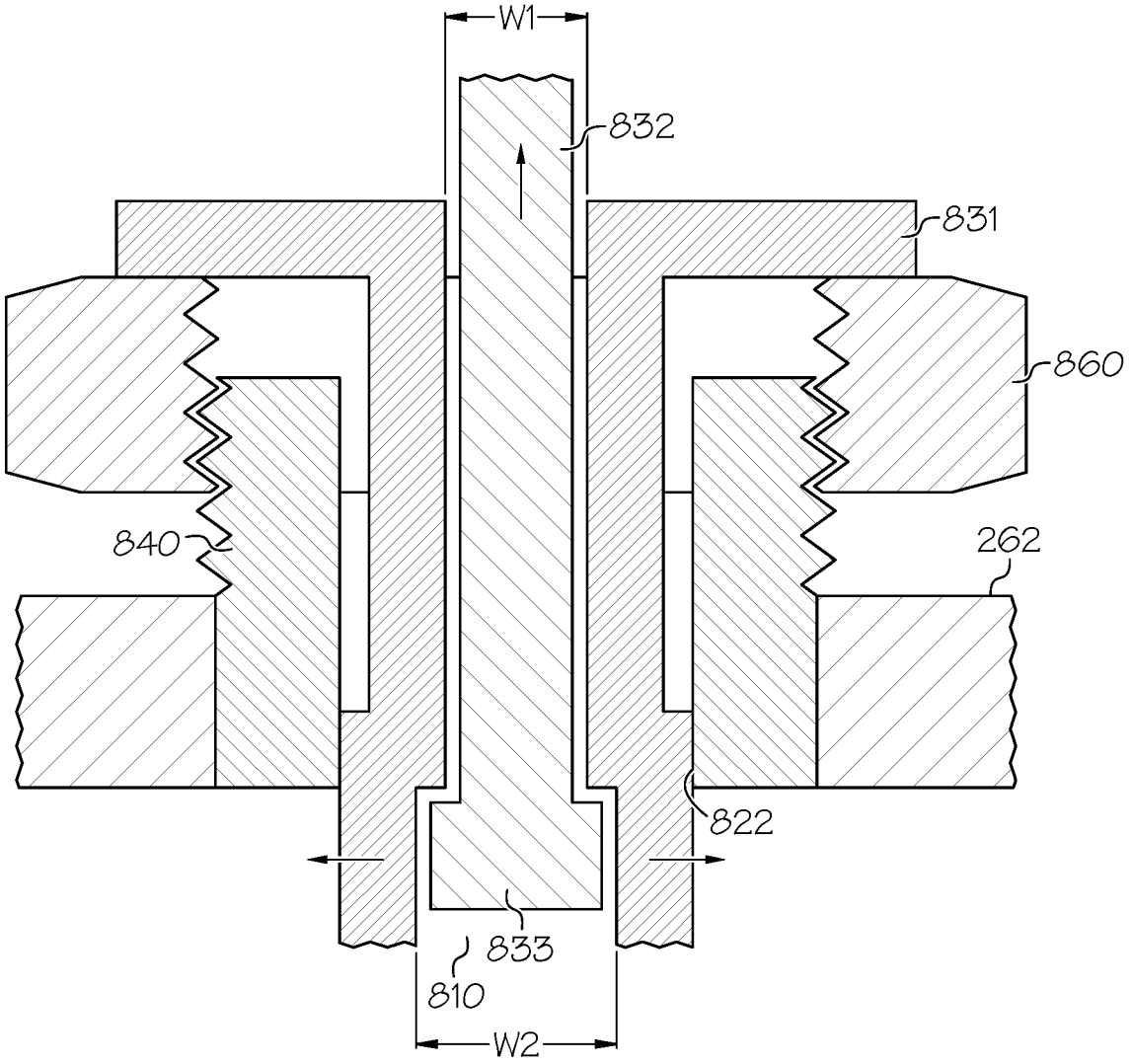
FIG. 17B is an enlarged view of a portion of the tuning element of FIG. 17A.

FIG. 17A is a cross-sectional view of a tuning element 800 according to further embodiments of the present invention inserted into a top cover 262 of and extending into a resonator 270 of a resonant cavity filter 250 in order to tune the frequency response of the filter 250. FIG. 17B is an enlarged view of a portion of the tuning element 800 of FIG. 17A.

As shown in FIGS. 17A-17B the resonant cavity filter 250 includes a housing 264 that has a cover 262. A resonator 270 is disposed within a cavity 268 of the filter 250 and has one or more sidewalls 272 that define an open interior 274. The top cover 262 includes an opening or aperture 263. A tuning element 800 is mounted on the top cover 262 for insertion (e.g., coaxial insertion) through the aperture 263 and into the interior 274 of the resonator 270. The tuning element 800 includes an elongated pin member 830 having a contact portion 822 that is used to secure the pin member 830 in a desired position to adjust a frequency response of the filter 250, where at least the contact portion 822 on a conductive outer surface 831 of the pin member 830 is free of threading such that the pin member 830 can be inserted through the aperture 263 and can be moved into and out of the interior 274 of the resonator 270 to adjust the frequency response of the filter 250 without creating metal particles due to friction between threaded elements.

The tuning element 800 also includes a turret member 840 having an opening therein that is aligned (e.g., coaxially aligned) with the interior 274 of the resonator 270. The opening in the turret member 840 and has a diameter that is sufficient or is otherwise is sized to accept and guide the pin member 830 into or out of the interior 274 of the resonator 270, e.g., by sliding the pin member 830 within the opening. The turret member 840 may include an external thread pattern 817 protruding outside of the aperture 263 in the top cover 262 opposite the resonator 270. A nut 860 having an opening that is sized to accept the protruding portion of the turret member 840 includes an internal thread pattern 867 that is configured to mate with the external thread pattern 817 of the turret member 840. Loosening or tightening of the nut 860 may be used in precise positioning of the pin member 830.

The pin member 830 further includes an elongated bar member 832 extending along a major axis of a hollow opening 810 in the conductive outer surface 831. The hollow opening 810 has a varying width (e.g., a non-constant diameter) along its major axis. The varying width of the opening 810 is illustrated by way of example with respective widths W1 and W2, but it will be understood that the opening 810 may gradually and/or continuously vary as well. As shown in FIG. 17B, the bar member 832 has a wider portion at an end thereof (illustrated as a bulb-shaped end portion 833) proximate the interior 274 of the resonator 270. Retraction of the bar member 832 into the hollow opening 810 along the major axis (illustrated by upward arrow in FIG. 17B) causes expansion of the contact portion 822 (illustrated by left and right arrows pointing away from the pin member 830 in FIG. 17B), deforming the conductive outer surface 831 to secure the pin member 830 in the desired position by interference fit with the sidewall of the turret member 840 (e.g., at base portion 865). In some embodiments, the interference fit with the sidewall of the turret member 840 by retraction of the bar member 832 may also be used for positioning the pin member 830, and in such embodiments the nut 860 may be omitted.

As similarly mentioned above, the metal-to-metal contact between the contact portion 822 (which is free of a threading pattern) and the turret member 840 created by the expansion mechanism 831, 832 may be advantageous in that deposition of metal particles into the interior 274 of the resonator 270 may be reduced and/or avoided when adjusting the position of the pin member 830 to tune the resonant filter 250. Also, as the external thread pattern 817 of the turret member 840 is outside of the aperture 263, any metal particles created by the rotational friction between the threading 867 on the internal surface of the nut 860 and the external surfaces of the turret member 840 may not be introduced into the interior 274 of the resonator 270.

Figure 18A:
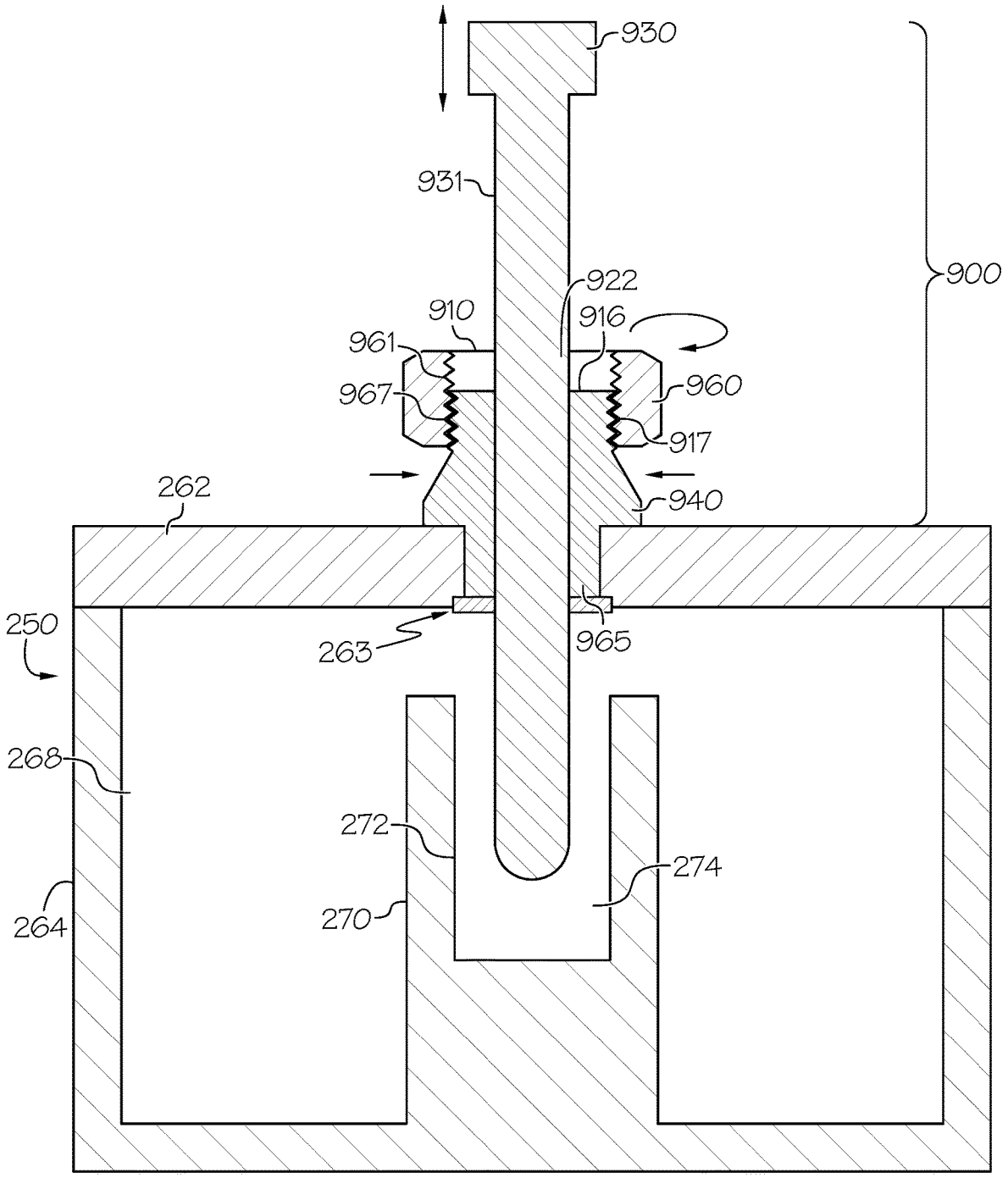
FIG. 18A is a cross-sectional view of a tuning element according to further embodiments of the present invention inserted into a top cover of and extending into a resonator of a resonant cavity filter in order to tune the frequency response of the filter.
Figure 18B:
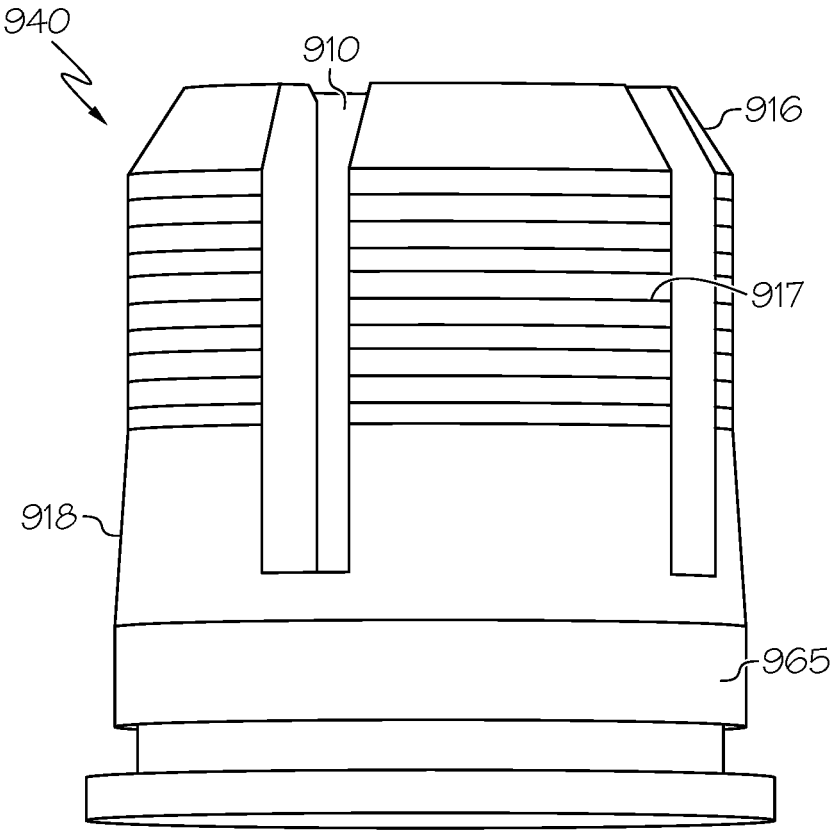
FIG. 18B is an enlarged perspective view of the turret member of FIG. 18A.

FIG. 18A is a cross-sectional view of a tuning element 900 according to further embodiments of the present invention inserted into a top cover 262 of and extending into one of a plurality of resonators 270 of a resonant cavity filter 250 in order to tune the frequency response of the filter 250. FIG. 18B is an enlarged perspective view of the turret member 940 of FIG. 18A.

Referring now to FIG. 18A, the resonant cavity filter 250 includes a housing 264 that has a top cover 262. A resonator 270, for example, a metallic coaxial resonator, is disposed within a cavity 268 of the filter 250 and has one or more sidewalls 272 (for example, a generally cylindrical shaped sidewall) that define an open interior 274. The top cover 262 includes an opening or aperture 263 that is aligned (e.g., coaxially aligned) with the interior 274 of the resonator 270.

A tuning element 900 is mounted on the top cover 262 for insertion (e.g., coaxial insertion) through the aperture 263 and into the interior 274 of the resonator 270. Although described and illustrated herein primarily with reference to coaxial insertion of the tuning element 900 into the resonator 270, it will be understood that the tuning element 900 can be out of concentricity or even beside the resonator 270 and still provide desired tuning effects described herein. The tuning element 900 includes an elongated pin member 930. The pin member 930 includes a conductive material and has a contact portion 922 on its outer surface 931 that is used to secure the elongated pin member 930 in a desired position to adjust a frequency response of the filter 250. At least the contact portion 922 on the outer surface 931 of the pin member 930 is free of threading, such that the pin member 930 can be inserted through the aperture 263 and can be moved into and out of the interior 274 of the resonator 270 to adjust the frequency response of the filter 250 without creating metal particles due to friction between threaded elements.

As shown in FIG. 18A, the tuning element 900 further includes a turret member 940 having an opening 910 therein that is aligned (e.g., coaxially aligned) with the interior 274 of the resonator 270, with a diameter that is sufficient or is otherwise is sized to accept the pin member 930 and guide the pin member 930 into or out of the interior 274 of the resonator 270, e.g., by sliding the pin member 930 within the opening 910. A base 965 of the turret member 940 is sized to fit in the aperture 263 for mounting on the cover 262, and may be mounted on the cover 262 by screw fit, press fit, soldering, or other mounting technique, as similarly described above with reference to the turret members 240 and 240' of FIGS. 9A and 9B.

As shown in greater detail in FIG. 18B, the turret member 940 includes a plurality of fingers 916 respectively positioned around a perimeter of the opening 910 therein. Although illustrated with reference to four fingers 916 by way of example, it will be understood that fewer or more fingers 916 may be included in some embodiments. The fingers 916 are flexible and/or elastic to grip the contact portion 922 of the pin member 930 therebetween, in order to secure the pin member 930 in the desired position to adjust the frequency response of the filter 250. The outer surfaces of upper portions of the fingers 916 (defining an upper or top part of the turret member 940) respectively include an external thread pattern 917. The outer surfaces of lower portions of the fingers 916 (defining a lower part of the turret member 940, above the base 965) may have a tapered shape. That is, the fingers 916 include both a tapered portion 918 and a threaded portion 917. The tapered portion 918 of the fingers 916 may define a width or diameter of the turret member 940 that is greater than that of the threaded portions 917.

The tuning element 900 further includes a ring-shaped member (illustrated as an internally-threaded nut 960) having an inner surface 961 that is shaped to mate with outer surfaces of the fingers 916. In particular, the nut 960 includes an internal thread pattern 967 on the inner surface 961 thereof that mates with the external thread pattern 917 of the fingers 916. The inner surface 961 of the nut 960 defines an inner diameter, and the tapered portions 918 of the fingers 916 define dimensions of the turret member 940 that increase from a dimension similar to the inner diameter of the nut 960 to a dimension greater than the inner diameter of the nut 960. In some embodiments, the tapered portions 918 and the threaded portions 917 of the fingers 916 may be combined, that is, the tapered portions of the fingers 916 may include the thread pattern 917, and the inner surface 961 of the nut 960 may include a complementary tapered and threaded portion 967 for mating with the thread pattern 917.

The pin member 930 may be secured in the desired position by tightening the nut 960 around the fingers 916 of the turret member 940 (illustrated by the rotating arrow in FIG. 18A). When the nut 960 reaches the tapered portions 918 defining dimensions that are greater than the inner diameter of the nut 960, the fingers 916 are deformed and forced towards the pin member 930 (illustrated by left and right arrows pointing toward the pin member 930 in FIG. 18A) to clamp the contact portion 922 of the outer surface 931 therebetween and secure the pin member 930 in a desired position. Likewise, the nut 960 can be loosened around the external thread pattern 917 of the fingers 916 (by rotating the nut 960 opposite to the rotating arrow in FIG. 18A, so as to move the nut 960 away from the tapered portions 918) such that the pin member 930 may be freely raised and lowered to extend different distances (or not at all) into the open interior 274 of the resonator 270 (illustrated by the up-and-down arrows in FIG. 18A).

As such, the turret member 940 may be secured or otherwise mounted to the top cover 262 above the aperture 263 such that the opening 910 in the turret member 940 is aligned with the interior 274 of the resonator 270, and the pin member 930 may be inserted into the opening 910 in the turret member 940 and may be raised and lowered into the open interior 274 of the resonator 270 to a desired position to adjust the frequency response of the filter 250. The metal-to-metal contact created by the clamping mechanism 916, 960, which is free of internal threading aligned with the interior 274 of the resonator 270, may be advantageous in that deposition of metal particles into the interior 274 of the resonator 270 may be reduced and/or avoided when adjusting the position of the pin member 930 to tune the resonant filter 250.

Also, as the external thread pattern 917 of the fingers 916 is outside of the aperture 263 and is otherwise not vertically aligned with the internal cavity 274 of the resonator 270, any metal particles created by the rotational friction between the threading 967 on the internal surface 961 of the nut 960 and the external surfaces of the fingers 916 may not be introduced into the interior 274 of the resonator 270. That is, similar to the embodiments of FIGS. 9 and 10, the tuning element 900 may include an externally-threaded perforated turret member 940 with elastic fingers 916 that define a tapered shape around an opening or bore 910 therein, which can be used to mechanically fix a pin member 930 at a desired position by contact between the fingers 916 and a non-threaded contact portion 922 of the pin member 930.

In some embodiments, the change in depth (or travel distance) of the pin member 230, 330, 430, 530, 630, 730, 830, 930 between its fully extracted and fully inserted positions with respect to the interior 274 of the resonator 270 may be up to about 30 millimeters or more (also be referred to herein as the "stroke" of the pin member). In some embodiments, the pin members 230, 330, 430, 530, 630, 730, 830, 930 may be used to tune the resonant frequency of resonant cavity filters as described herein between about 1720-1920 MHz. However, it will be appreciated that the filters may be designed to operate in any appropriate frequency band or bands.

Resonant cavity filters and associated tuning elements according to embodiments of the present invention may provide a number of advantages over conventional filters and tuning screws. For example, by fixing or securing the tuning pin member in its desired position to tune the frequency response of the filter via interference fit, interfaces between threaded components may be eliminated or provided to be remote from the opening in the filter housing. This may reduce or eliminate the possibility that metal shavings, which may be created by rotational friction of such elements, can fall into the interior of the filter. Thus, filters and associated tuning elements according to embodiments of the present invention may exhibit improved PIM distortion.

It will be appreciated that the filters according to embodiments of the present invention may be used to implement a wide variety of different devices including duplexers, diplexers, multiplexers, combiners and the like. It will be appreciated that the filters according to embodiments of the present invention may also be used in applications other than cellular communications systems.

While various embodiments of the present invention have been described above, it will be appreciated that these embodiments may be changed in many ways without departing from the scope of the present invention, which is detailed in the appended claims. It will also be appreciated that the various embodiments disclosed herein may be combined in any way to create additional embodiments, all of which are within the scope of the present invention. For example, the expansion-based pin members 430 and/or 530 of FIGS. 13 and 14 may be sized and configured to fit in the openings 210 and/or 310 of the turret members 240 and/or 340 of FIGS. 6-10 and 11-12, to provide an interference fit with the turret members 240 and/or 340 rather than directly with the sidewalls of the aperture 263 in the top cover 262.

The present invention has been described above with reference to the accompanying drawings, in which certain embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "front" or "back" or "top" or "bottom" may be used herein to describe a relationship of one element, layer or region to another element, layer or region as illustrated in the figures. It will be understood that these terms are intended to encompass different orientations of the device in addition to the orientation depicted in the figures.

Aspects and elements of all of the embodiments disclosed above can be combined in any way and/or combination with aspects or elements of other embodiments to provide a plurality of additional embodiments.

In the drawings and specification, there have been disclosed typical embodiments of the invention and, although specific terms are employed, they are used in a generic and descriptive sense only and not for purposes of limitation, the scope of the invention being set forth in the following claims.

The invention claimed is:

1. A resonant cavity filter comprising:

a housing having a resonator therein and a top cover with an aperture therein that is aligned with an interior of the resonator; and a tuning element comprising:

an elongated pin member that is mounted for insertion through the aperture in the top cover and into the interior of the resonator, and is fixed in a desired position by an interference fit with a contact portion that is free of a thread pattern on a conductive outer surface of the elongated pin member; and a turret member mounted on the top cover and having an opening therein that is coaxially aligned with the aperture, wherein the elongated pin member extends through the opening in the turret member for the insertion through the aperture and into the interior of the resonator, wherein the turret member comprises a threaded hole in a sidewall thereof that is configured to accept a screw-shaped member, wherein the screw-shaped member is configured to be laterally threaded into the threaded hole to pin the contact portion between the screw-shaped member and a sidewall of the opening in the turret member to fix the elongated pin member in the desired position.

2. A resonant cavity filter comprising:

a housing having a resonator therein and a top cover with an aperture therein that is aligned with an interior of the resonator; and a tuning element comprising:

an elongated pin member that is mounted for insertion through the aperture in the top cover and into the interior of the resonator, and is fixed in a desired position by an interference fit with a contact portion that is free of a thread pattern on a conductive outer surface of the elongated pin member; and a turret member mounted on the top cover and having an opening therein that is coaxially aligned with the aperture, wherein the elongated pin member extends through the opening in the turret member for the insertion through the aperture and into the interior of the resonator, wherein the conductive outer surface of the elongated pin member is expandable to contact a sidewall of the aperture or a sidewall of the turret member to secure the elongated pin member in the desired position.

3. A resonant cavity filter comprising:

a housing having a resonator therein; and a tuning element comprising:

an elongated pin member having a conductive outer surface, wherein the tuning element is mounted for insertion of the elongated pin member into an interior of the resonator and the conductive outer surface comprises a contact portion by which the elongated pin member is secured in a desired position to adjust a frequency response of the resonant cavity filter, wherein the contact portion is free of threading; and a turret member having an opening therein that is aligned with the interior of the resonator, wherein the elongated pin member extends through the opening in the turret member for the insertion into the interior of the resonator, wherein the turret member comprises a plurality of fingers respectively positioned around a perimeter of the opening therein, wherein the fingers are flexible and/or elastic to grip the contact portion of the elongated pin member therebetween to secure the elongated pin member in the desired position.

4. The resonant cavity filter of claim 3, wherein the tuning element further comprises a ring-shaped member comprising an inner surface that is shaped to mate with outer surfaces of the fingers such that acceptance of the fingers into the ring-shaped member causes the fingers to grip the contact portion of the elongated pin member therebetween.

5. The resonant cavity filter of claim 4, wherein the outer surfaces of the fingers define a tapered shape, and wherein the inner surface of the ring-shaped member is tapered to mate with the tapered shape of the fingers.

6. The resonant cavity filter of claim 4, wherein the outer surfaces of the fingers comprise an external thread pattern, and wherein the ring-shaped member is a nut comprising an internal thread pattern on the inner surface thereof that is configured to mate with the external thread pattern.

7. The resonant cavity filter of claim 6, wherein first portions of the outer surfaces of the fingers comprise the external thread pattern, and wherein second portions of the outer surfaces of the fingers are tapered relative to the first portions.

8. The resonant cavity filter of claim 7, wherein the second portions of the outer surfaces of the fingers are tapered from a dimension corresponding to a diameter defined by the inner surface of the ring-shaped member to a dimension greater than the diameter.

9. The resonant cavity filter of claim 4, wherein the ring-shaped member has an elasticity sufficient to cause the fingers to grip the contact portion of the elongated pin member therebetween responsive to acceptance of the fingers into the ring-shaped member.

10. The resonant cavity filter of claim 3, wherein the resonant cavity filter comprises a duplexer or a diplexer.

11. The resonant cavity filter of claim 3, wherein the housing further comprises a top cover with an aperture therein that is aligned with the interior of the resonator, and wherein the turret member is mounted on the cover with the opening therein coaxially aligned with the aperture.

12. The resonant cavity filter of claim 11, wherein the turret member comprises an extended base portion that extends through and beyond the aperture in the top cover and into the interior of the resonator.

13. The resonant cavity filter of claim 11, wherein the aperture in the top cover is tapered in a direction away from the interior of the resonator, wherein the turret member comprises an external thread pattern protruding outside of the aperture opposite the resonator that is configured to mate with an internal thread pattern of a nut, and wherein outer surfaces of the fingers are tapered to mate with the aperture such that acceptance of the fingers into the aperture responsive to tightening of the nut around the external thread pattern of the turret member causes the fingers to grip the contact portion of the elongated pin member therebetween.

14. A resonant cavity filter comprising:

a housing having a resonator therein; and a tuning element comprising:

an elongated pin member having a conductive outer surface, wherein the tuning element is mounted for insertion of the elongated pin member into an interior of the resonator and the conductive outer surface comprises a contact portion by which the elongated pin member is secured in a desired position to adjust a frequency response of the resonant cavity filter, wherein the contact portion is free of threading;

a turret member having an opening therein that is aligned with the interior of the resonator, wherein the elongated pin member extends through the opening in the turret member for the insertion into the interior of the resonator, and wherein the opening in the turret member comprises an internal thread pattern and is tapered toward the interior of the resonator; and an elastic ring and a nut that are sized to fit within the opening in the turret member, the nut having an external thread pattern that is configured to mate with the internal thread pattern, wherein the elongated pin member extends through the elastic ring and the nut for the insertion into the interior of the resonator, and wherein tightening the nut advances the elastic ring into the opening and toward the interior of the resonator causing compression of the elastic ring against the contact portion to secure the elongated pin member in the desired position.

15. A resonant cavity filter comprising:

a housing having a resonator therein and a top cover with an aperture therein that is aligned with an interior of the resonator; and a tuning element comprising an elongated pin member having a conductive outer surface, wherein the tuning element is mounted for insertion of the elongated pin member into the interior of the resonator and the conductive outer surface comprises a contact portion by which the elongated pin member is secured in a desired position to adjust a frequency response of the resonant cavity filter, wherein the contact portion is free of threading, and wherein the conductive outer surface of the elongated pin member is expandable to contact a sidewall of the aperture to secure the elongated pin member in the desired position by an interference fit with the contact portion.

16. The resonant cavity filter of claim 15, wherein the elongated pin member comprises a hollow opening extending along a major axis thereof within the conductive outer surface thereof.

17. The resonant cavity filter of claim 16, wherein the tuning element further comprises a screw-shaped member, wherein the hollow opening in the elongated pin member is tapered and is configured to accept the screw-shaped member, and wherein insertion of the screw-shaped member into the hollow opening causes expansion of the contact portion of the conductive outer surface to contact the sidewall of the aperture to secure the elongated pin member in the desired position.

18. The resonant cavity filter of claim 17, wherein the hollow opening comprises an internal thread pattern that is configured to mate with a thread pattern of the screw-shaped member, and wherein an end of the elongated pin member opposite the hollow opening is closed.

19. The resonant cavity filter of claim 16, wherein the elongated pin member further comprises an elastic inner portion defining the hollow opening and including the conductive outer surface thereon, wherein the elastic inner portion is configured for compression during insertion of the elongated pin member into the aperture, and for expansion responsive to release of the compression to secure the elongated pin member in the desired position by the interference fit with the contact portion.

20. A resonant cavity filter comprising:

a housing having a resonator therein; and a tuning element comprising:

an elongated pin member having a conductive outer surface, wherein the tuning element is mounted for insertion of the elongated pin member into an interior of the resonator and the conductive outer surface comprises a contact portion by which the elongated pin member is secured in a desired position to adjust a frequency response of the resonant cavity filter, wherein the contact portion is free of threading; and a turret member having an opening therein that is aligned with the interior of the resonator, wherein the elongated pin member extends through the opening in the turret member for the insertion into the interior of the resonator, wherein the elongated pin member comprises an elongated bar member extending within a hollow opening in the conductive outer surface, wherein the hollow opening has a varying width and the elongated bar member has a wider portion at an end thereof proximate the interior of the resonator, and wherein retraction of the elongated bar member into the hollow opening causes expansion of the contact portion to contact a sidewall of the turret member to secure the elongated pin member in the desired position.

21. The resonant cavity filter of claim 20, wherein the turret member comprises an external thread pattern protruding opposite the resonator, wherein the tuning element further comprises a nut having an internal thread pattern on an inner surface thereof that is configured to mate with the external thread pattern.

22. A resonant cavity filter comprising:

a housing having a resonator therein; and a tuning element comprising:

an elongated pin member having a conductive outer surface, wherein the tuning element is mounted for insertion of the elongated pin member into an interior of the resonator and the conductive outer surface comprises a contact portion by which the elongated pin member is secured in a desired position to adjust a frequency response of the resonant cavity filter, wherein the contact portion is free of threading; and a turret member having an opening therein that is aligned with the interior of the resonator, wherein the elongated pin member extends through the opening in the turret member for the insertion into the interior of the resonator, wherein the turret member has a threaded hole in a sidewall thereof that is configured to accept a screw-shaped member, wherein the screw-shaped member is configured to be laterally threaded into the threaded hole to contact the contact portion to secure the elongated pin member in the desired position.

23. A resonant cavity filter comprising:

a housing having a resonator therein and a top cover with an aperture therein that is aligned with an interior of the resonator; and a tuning element comprising:

an elongated pin member that is mounted for insertion through the aperture in the top cover and into the interior of the resonator, and is fixed in a desired position by an interference fit with a contact portion that is free of a thread pattern on a conductive outer surface of the elongated pin member; and a turret member mounted on the top cover and having an opening therein that is coaxially aligned with the aperture, wherein the elongated pin member extends through the opening in the turret member for the insertion through the aperture and into the interior of the resonator, wherein the turret member comprises a plurality of fingers respectively positioned around a perimeter of the opening therein, wherein the fingers are flexible to clamp the contact portion of the elongated pin member therebetween to fix the elongated pin member in the desired position.

24. The resonant cavity filter of claim 23, wherein first portions of outer surfaces of the fingers comprise an external thread pattern, and wherein second portions of the outer surfaces of the fingers are tapered from a dimension corresponding to a diameter defined by the first portions to a dimension greater than the diameter.

25. The resonant cavity filter of claim 23, wherein the resonant cavity filter comprises a duplexer or a diplexer.

* * * * *